US012696975B2

(12) United States Patent
Roth

(10) Patent No.: US 12,696,975 B2
(45) Date of Patent: Aug. 4, 2026

(54) ADJUSTABLE TATTOO TABLE

(71) Applicant: Sonny I. Roth, Colorado Springs, CO (US)

(72) Inventor: Sonny I. Roth, Colorado Springs, CO (US)

( * ) Notice: Subject to any disclaimer, the term of this patent is extended or adjusted under 35 U.S.C. 154(b) by 46 days.

(21) Appl. No.: 18/375,091

(22) Filed: Sep. 29, 2023

(65) Prior Publication Data

US 2024/0108126 A1 Apr. 4, 2024

Related U.S. Application Data

(60) Provisional application No. 63/411,376, filed on Sep. 29, 2022.

(51) Int. Cl.
*A47B 37/00* (2006.01)

(52) U.S. Cl.
CPC ..... *A47B 37/00* (2013.01)

(58) Field of Classification Search
CPC ..... A47B 2200/0085; A47B 37/00; A47B 2200/0006; A47B 2210/0062; A47B 2210/0037; A47B 2210/004; A47B 2210/0043
USPC ..... 108/29; 312/334.28
See application file for complete search history.

(56) References Cited

U.S. PATENT DOCUMENTS 4,057,240 A 11/1977 Damico et al.
5,597,146 A 1/1997 Putman
8,677,529 B2 3/2014 Jackson
11,013,574 B1 5/2021 Gomez et al.
2007/0289063 A1 12/2007 Martin et al.
2010/0005998 A1* 1/2010 Kempf ..... B66C 9/02 104/106
2010/0032927 A1 2/2010 Gordon
2013/0038094 A1 2/2013 Chen et al.
2019/0343291 A1 11/2019 Avegno
2020/0253805 A1 8/2020 Fouts et al.
2020/0368089 A1 11/2020 Zahynacz et al.
(Continued)

FOREIGN PATENT DOCUMENTS

CH 705091 A2 * 12/2012 ..... A47B 17/033
CN 108720384 A * 11/2018 ..... A47B 97/00
(Continued)

OTHER PUBLICATIONS

Merriam-Webster Dictionary Definition of "Assembly". (Year: 2025).*

*Primary Examiner* — Matthew W Ing
(74) *Attorney, Agent, or Firm* — Polsinelli PC

(57) ABSTRACT

Implementations described herein provide systems and methods for supporting a person receiving a tattoo. In one implementation, a tattoo table includes a platform having a padded body operable to receive a person thereon. A first support and a second support, each of which are configured to extend or retract along respective longitudinal axes, are coupled to the platform at opposite ends. The first support and the second support are each operable to extend to raise the height of the tattoo table and/or to retract to lower the height of the tattoo table. A support rail is coupled to a front side of the platform and is operable to slidably support a light source such that the light source is adjustable along the length of the support rail. One or more controllers are in communication with the first and second support.

20 Claims, 16 Drawing Sheets

(56) References Cited

U.S. PATENT DOCUMENTS

| | | | | |
|---|---|---|---|---|
| 2022/0202185 | A1 | 6/2022 | Andoloro et al. | |
| 2022/0400848 | A1 * | 12/2022 | Xiang | A47B 21/02 |

FOREIGN PATENT DOCUMENTS

| | | | | |
|---|---|---|---|---|
| DE | 3911017 | A1 * | 10/1990 | A47B 21/06 |
| DE | 202015103821 | U1 * | 11/2016 | |
| RU | 174896 | U1 * | 11/2017 | |
| WO | WO-2021103638 | A1 * | 6/2021 | A47B 11/00 |

* cited by examiner

ADJUSTABLE TATTOO TABLE

CROSS-REFERENCE TO RELATED APPLICATIONS

This application claims the benefit of U.S. Provisional Application No. 63/411,376, filed Sep. 29, 2022, which is hereby incorporated by reference in its entirety herein.

FIELD

Aspects of the present disclosure relate generally to adjustable tables and more particularly to systems and methods for supporting a person receiving a tattoo.

BACKGROUND

Tattooing involves making indelible markings or design on a person's skin. Typically, a tattoo artist inserts pigment into punctures within the skin of the person receiving the tattoo (e.g., the client). Tattoo artists have traditionally used massage tables, chairs, and armrests to support the client and also used auxiliary lighting to provide lighting while tattooing the client. However, these traditional setups are inconvenient (e.g., cumbersome) for the tattoo artist. Additionally, these traditional setups create uncomfortable working positions for both the tattoo artist and the client.

SUMMARY

Implementations described and claimed herein address the foregoing problems by providing systems and methods for supporting a person receiving a tattoo. In one implementation, an adjustable tattoo table can support a person receiving a tattoo. The adjustable tattoo table includes a platform that has a padded body, a first support that supports a first end of the platform, a second support that supports a second end of the platform, a support rail, and one or more controllers. The platform extends from the first end to the second end, defines a longitudinal axis that is substantially horizontal, and is located a height above the ground. The padded body of the platform defines a top surface that can support the person receiving the tattoo. The first support can extend or retract along a longitudinal axis of the first support, which is substantially perpendicular to the longitudinal axis of the platform. The second support can extend or retract along a longitudinal axis of the second support, which is substantially perpendicular to the longitudinal axis of the platform. An open volume is defined between the first support and the second support. When the first support and the second support are each extended, the height of the platform raises. When the first support and the second support are each retracted, the height of the platform lowers. The support rail is coupled to the platform and defines a length. A lighting assembly is slidably supported by the support rail, such that the position of the lighting assembly can be slidably adjusted along the length of the support rail. The one or more controls can cause the first support and the second support to extend or retract to cause the height of the platform to transition.

In certain instances, the one or more controllers cause the first support and the second support to each extend or retract simultaneously.

In certain instances, a normal line, which is defined by the platform, is substantially parallel to both the longitudinal axis of the first support and the longitudinal axis of the second support, and the normal line remains substantially parallel to both the longitudinal axis of the first support and the longitudinal axis of the second support when the height of the platform is transitioning.

In certain instances, the longitudinal axis of the platform remains substantially horizontal when the height of the platform is transitioning.

In certain instances, the top surface of the padded body defines a plane that is substantially horizontal, and the plane remains substantially horizontal when the height of the platform is transitioning.

In certain instances, the platform further includes a frame that supports the padded body, and the support rail is incorporated into the frame of the platform. In certain instances, the support rail defines a longitudinal axis, and the platform defines a longitudinal axis that is substantially parallel to the longitudinal axis of the support rail.

In certain instances, both the support rail and at least one of the one or more controllers are located on a front side of the platform.

In certain instances, the platform further includes a frame supporting a substrate constructed of a non-opaque material. The padded body is releasably engaged to the frame or to a top surface of the substrate via magnets. A light source is located beneath the top surface of the substrate. When the padded body is removed from the substrate and the light source is illuminated, the light source and the substrate form a light box.

In another implementation, an adjustable tattoo table can support a person receiving a tattoo. The adjustable tattoo table includes a platform including a padded body, a first support that supports a first end of the platform, a second support that supports a second end of the platform, a support rail, and one or more controllers. The platform extends from the first end to the second end, defines a longitudinal axis that is substantially horizontal, and is located a height above the ground. The padded body of the platform defines a top surface that can support the person receiving the tattoo, and the top surface defines a place that is substantially horizontal. The first support and the second support can each extend such that the height of the platform raises. The first support and the second support can each retract such that the height of the platform lowers. The longitudinal axis of the platform remains substantially horizontal when the height of the platform is raised or lowered. The support rail is coupled to the platform and defines a length. A lighting assembly is slidably supported by the support rail, such that the position of the lighting assembly can be slidably adjusted along the length of the support rail. The one or more controls can cause the first support and the second support to extend or retract simultaneously such that the top surface remains horizontal.

In certain instances, the first support, the second support, and a bottom of the platform define an open volume therebetween. The open volume can receive at least a portion of one or more legs of a tattoo artist therein.

In certain instances, the adjustable tattoo table includes a safety, which inhibits the first support and the second support from extending or retracting, in communication with the one or more controllers.

In certain instances, the support rail defines a longitudinal axis, and the platform defines a longitudinal axis that is substantially parallel to the longitudinal axis of the support rail.

In certain instances, the platform includes a frame that supports the padded body, and the support rail is part of the frame of the platform.

In certain instances, the first support can extend or retract along a first longitudinal axis and the second support can extend or retract along a second longitudinal axis. The first longitudinal axis is substantially parallel to the second longitudinal axis.

In certain instances, the first support includes a first linear actuator, and the second support includes a second linear actuator.

In certain instances, the padded body is releasably secured to the platform, and removing the padded body from the platform exposes a substrate that is constructed of a non-opaque material and defines a top surface. A light source provides a backlight for the top surface of the substrate.

In certain instances, both the support rail and at least one of the one or more controllers are located on a front side of the platform.

In another implementation, a method of supporting a person on an adjustable tattoo table while the person is receiving a tattoo is provided. The method includes receiving the person on a platform at a first height. The platform has a first end, a second end, and defines a longitudinal axis that is substantially horizontal. The platform is supported by a first support at the first end and a second support at the second end, and the first support and the second support define an open area therebetween. The method further includes receiving a first application of force on a control of a controller, such that the first application of force causes the platform to transition from the first height to a second height that is different than the first height. When the platform transitions from the first height to the second height, the longitudinal axis remaining substantially horizontal. The method further includes receiving a second application of force on a lighting assembly, such that the second application of force causes the lighting assembly to translate from a first position on a rail to a second position on the rail that is different than the first position. The rail is coupled to the platform and parallel to the longitudinal axis of the platform. The lighting assembly including a light source. The method further includes receiving a third application of force on a control of a controller, such that the third application of force causes the light source to illuminate at least a portion of a working area.

In certain instances, the first support and the second support each extend along a longitudinal axis when the platform transitions from the first height to the second height. The longitudinal axis of the first support and the second support are substantially perpendicular to the longitudinal axis of the platform.

Other implementations are also described and recited herein. Further, while multiple implementations are disclosed, still other implementations of the presently disclosed technology will become apparent to those skilled in the art from the following detailed description, which shows and describes illustrative implementations of the presently disclosed technology. As will be realized, the presently disclosed technology is capable of modifications in various aspects, all without departing from the spirit and scope of the presently disclosed technology. Accordingly, the drawings and detailed description are to be regarded as illustrative in nature and not limiting.

DETAILED DESCRIPTION

Aspects of the presently disclosed technology relate to an adjustable tattoo table. In some aspects, the tattoo table includes two adjustable legs that support a horizontal top, a rail that slidably supports a mount for a light, and a controller. The height of the horizontal top can be raised or lowered in the vertical direction, by adjusting the height of each of the adjustable legs simultaneously so that the top of the table remains horizontal as the height of the horizontal top is adjusted. The adjustable legs define a space, which can accommodate the feet or legs of the tattoo artist, between the adjustable legs and below the horizontal top of the tattoo table.

The rail is fixed along the front end of the table in a horizontal orientation, and the rail slidably supports a mount for an articulating light. That is, the mount and the associated light, are slidable in the horizontal direction along the length of the rail to adjust the position of the mount. Because the rail is fixed to the table, the mount and the articulating light are raised or lowered in the vertical direction when the height of the horizontal top is raised or lowered. The controller is located at the front end of the tattoo table, such that the controller is convenient for the tattoo artist to access even while tattooing the client. The controller can control the height of the horizontal top and the illumination of the articulating light.

The adjustable tattoo table disclosed herein may improve comfort, convenience, longevity, and efficiency over conventional tattoo tables (e.g., massage tables, chairs, armrests) with auxiliary lighting. The adjustable tattoo table can allow the artist to work without hunching over and/or without navigating the artist's feet and legs around supports and/or lines under the table. For example, the adjustable tattoo table can allow the artist to adjust the table to a desired height and adjust the light to a desired position (and brightness) without having to deal with a cumbersome conventional setup. That is, the adjustable tattoo table can allow the artist raise or lower the table without having to get up to adjust the table and/or work light during a tattooing session. This, in turn, can improve the health of the tattoo artist. Moreover, this can increase the efficiency of the tattoo artist, which can save time and money.

Figure 1:
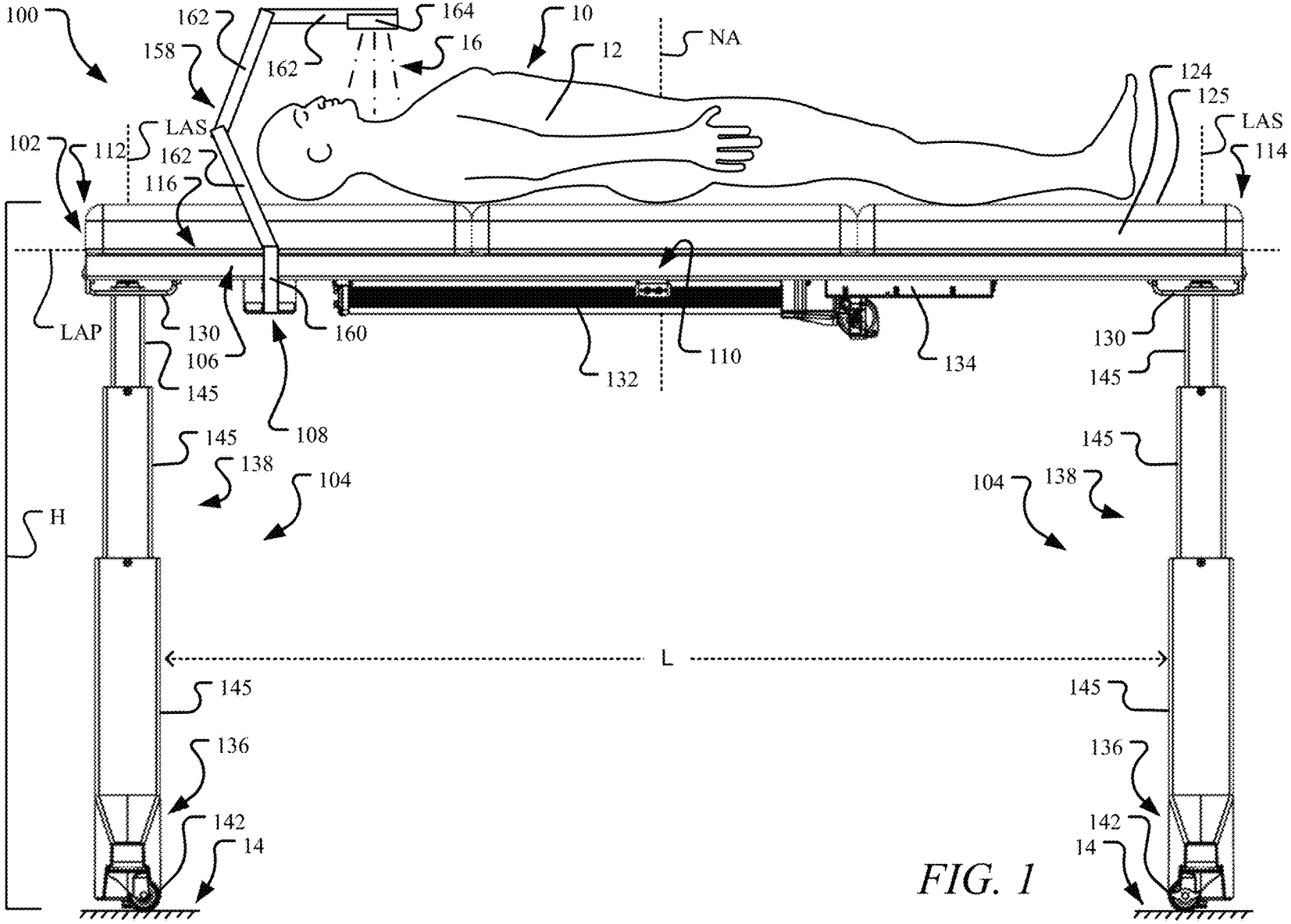
FIG. 1 illustrates a side view of an example adjustable tattoo table that is supporting a person receiving a tattoo.
Figure 2:
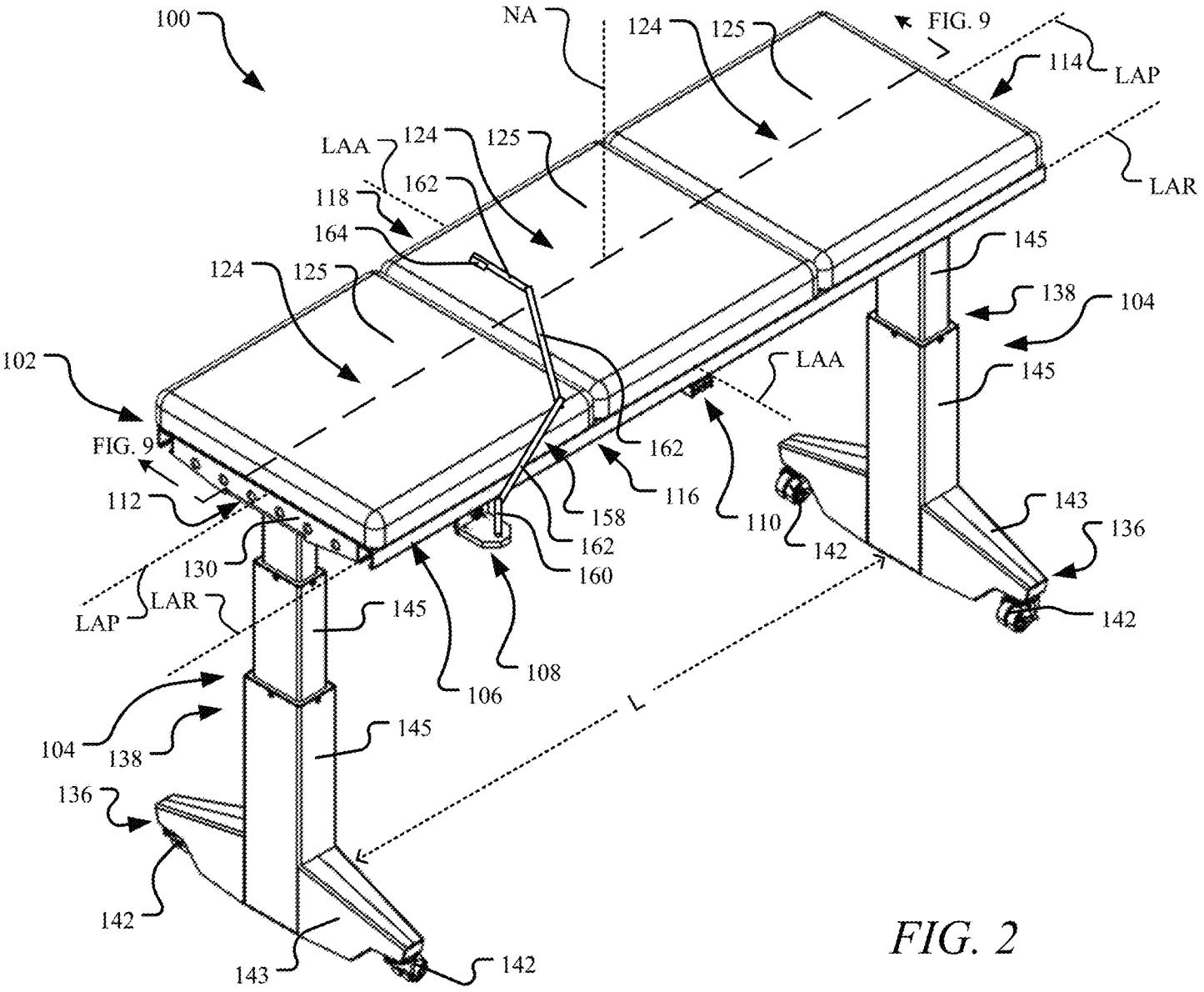
FIG. 2 illustrates a perspective view of the adjustable tattoo table.

With reference to FIGS. 1-2, one implementation of an adjustable tattoo table 100 (also referred to as a tattoo table assembly) is illustrated in a side view and a perspective view, respectively. The adjustable tattoo table 100 includes a platform 102, adjustable supports 104 that support the platform 102, a support rail 106, a lighting assembly 108 slidably engaged with the support rail 106, and a controller 110.

The platform 102 is configured to receive a person 10 thereon (as illustrated for example in FIG. 1), and to support the person 10 while the person 10 receives a tattoo on their body 12. The person 10 receiving the tattoo can be referred to as the client. The person applying the tattoo (not shown in figures) can be referred to as the tattoo artist.

The platform 102 defines a longitudinal axis LAP, a lateral axis LAA, a normal axis NA, and a height H. The longitudinal axis LAP and the lateral axis LAA define a plane (e.g., horizontal plane) of the platform 102. When the adjustable tattoo table 100 is supported by ground 14 that is substantially horizontal (e.g., flat, level), as illustrated for example in FIG. 1, the longitudinal axis LAP is substantially horizontal, the lateral axis LAA is substantially horizontal, and the normal axis NA is substantially vertical. Similarly, the plane (defined by the longitudinal axis LAP and the lateral axis LAA) of the platform 102 is substantially horizontal.

The height H of the platform 102 (also referred to as the height of the adjustable tattoo table 100) can be adjusted (e.g., raised, lowered) along the normal axis NA (e.g., adjusted in the vertical direction). As the height H of the platform 102 is adjusted (e.g., raised, lowered), both the longitudinal axis LAP and the lateral axis LAA remain substantially horizontal. Similarly, the plane (defined by the longitudinal axis LAP and the lateral axis LAA) of the platform 102 remains substantially horizontal.

In some implementations, the height H of the platform 102 can be between 20-inches and 52-inches. In some examples, height H of the platform 102 can be between 24-inches and 48-inches. In some examples, a minimum height of the platform 102 (e.g., when the adjustable supports 104 are fully retracted) can be 24-inches or greater. In at least one example, the minimum height can be approximately 24-inches. In some examples, a maximum height of the platform 102 (e.g., when the adjustable supports 104 are fully extended) can be up to 48-inches (or 48-inches or less). In at least one example, the maximum height can be approximately 48-inches.

The adjustable supports 104 (also referred to as adjustable legs) are actuated (e.g., raised, lowered) to adjust the height H of the platform 102. In this manner, the height H of the platform 102 can transition between a raised height (as illustrated for example in FIG. 15C) and/or a lowered height (as illustrated for example in FIG. 15A). For the longitudinal axis LAP and the lateral axis LAA of the platform 102 to remain substantially horizontal when the height of the platform 102 is transitioning, the adjustable supports 104 can be simultaneously actuated.

The adjustable supports 104, which support the platform 102, are located at opposite ends the platform 102. In this manner, the adjustable supports 104 define a length L therebetween. The length L remains constant (e.g., the length is fixed) during operation of the adjustable tattoo table 100. An open volume (also referred to as an open section) is defined by the length L (between the adjustable supports 104) and below the platform 102. Because the length L remains constant, the open volume increases or decreases corresponding to when the adjustable supports 104 are raised or lowered, respectively. The open volume can receive portions of the body of the tattoo artist (e.g., feet, legs) and/or equipment (e.g., chair) when the tattoo artist is tattooing the body 12 of the person 10. In this manner, the open volume provides advantageous space for the tattoo artist to tattoo the body 12 of the person 10 comfortably and efficiently. In some implementations, the length L is more than 75-percent of the length of the platform 102 (e.g., length from the left end 112 to the right end 114). In some examples, the length L is more than 80-percent of the length of the platform 102. In some examples, the length L is more than 85-percent of the length of the platform 102. In some examples, the length L is more than 90-percent of the length of the platform 102. In some examples, the length L is more than 95-percent of the length of the platform 102.

The lighting assembly 108 is configured to illuminate at least a portion of a working area, such as the body 12 (or portion of the body 12) of the person 10 that is being tattooed. The lighting assembly 108 is slidably supported by the support rail 106, which is coupled to (or part of) the platform 102. As a result, the support rail 106 (and the associated lighting assembly 108) is correspondingly raised or lowered (e.g., vertical position) when the height H of the platform 102 is raised or lowered. Thus, in some instances, the tattoo artist can adjust the height H of the platform 102 without having to adjust the position of the lighting assembly 108. The position of the lighting assembly 108 on the support rail 106 (e.g., horizontal position) can be adjusted (e.g., translated to the left, translated to the right) along the length of the support rail 106. Moreover, the lighting assembly 108 can include one or more articulating arms 162, which can allow further adjustments to the position of the light source 164 (and the associated illumination). In some implementations, the support rail 106 can be located on the front end 116 of the platform 102, such that the lighting assembly 108 is conveniently accessible for the tattoo artist. For example, the front end 116 can be the working side for the tattoo artist.

The controller 110 can be located on the front end 116 of the platform 102, such that the controller 110 is conveniently accessible for the tattoo artist. In some implementations, the controller 110 can be slidably engaged with the rail 106, such that the controller 110 can be translated (e.g., moved left, moved right) along the length of the rail 106. In this manner, the controller 110 can provide easy access for the tattoo artist while tattooing the person 10. The controller 110 can include multiple controls (e.g., height control for the platform 102, illumination control for the lighting assembly 108). Although, the figures illustrate a single controller 110, in some implementations the adjustable tattoo table 100 can include multiple controllers 110 to control various components of the adjustable tattoo table 100 (e.g., height of the platform 102, illumination of the lighting assembly 108). For example, in one implementation, the height of the platform 102 can be controlled by a foot control (e.g., located below the adjustable tattoo table 100) rather than the controller 110 mounted to the adjustable tattoo table 100.

The controller 110 can include a height control (e.g., button, switch, knob, dial, lever), which controls the height of the platform 102. In some implementations, the controller 110 can include a safety control (e.g., button, switch, knob, dial, lever) that inhibits the actuation of the adjustable supports 104 unless the safety control actuated before the height control.

The controller 110 can include an illumination control (e.g., button, switch, knob, dial, lever), which controls the illumination (e.g., on, off, brighter, dimmer) of the light source 164 (of the lighting assembly 108). In some implementations, one illumination control controls both the on/off function and the brighter/dimmer function of the light source 164. In other implementations, a first illumination control controls the on/off function and a second illumination control controls brighter/dimmer function of the light source 164.

Similarly, the controller 110 can include an illumination control (e.g., button, switch, knob, dial, lever), which controls the illumination (e.g., on, off, brighter, dimmer) of the light source 123. In some implementations, one illumination control controls both the on/off function and the brighter/dimmer function of the light source 123. In other implementations, a first illumination control controls the on/off function and a second illumination control controls brighter/dimmer function of the light source 123.

Figure 3:
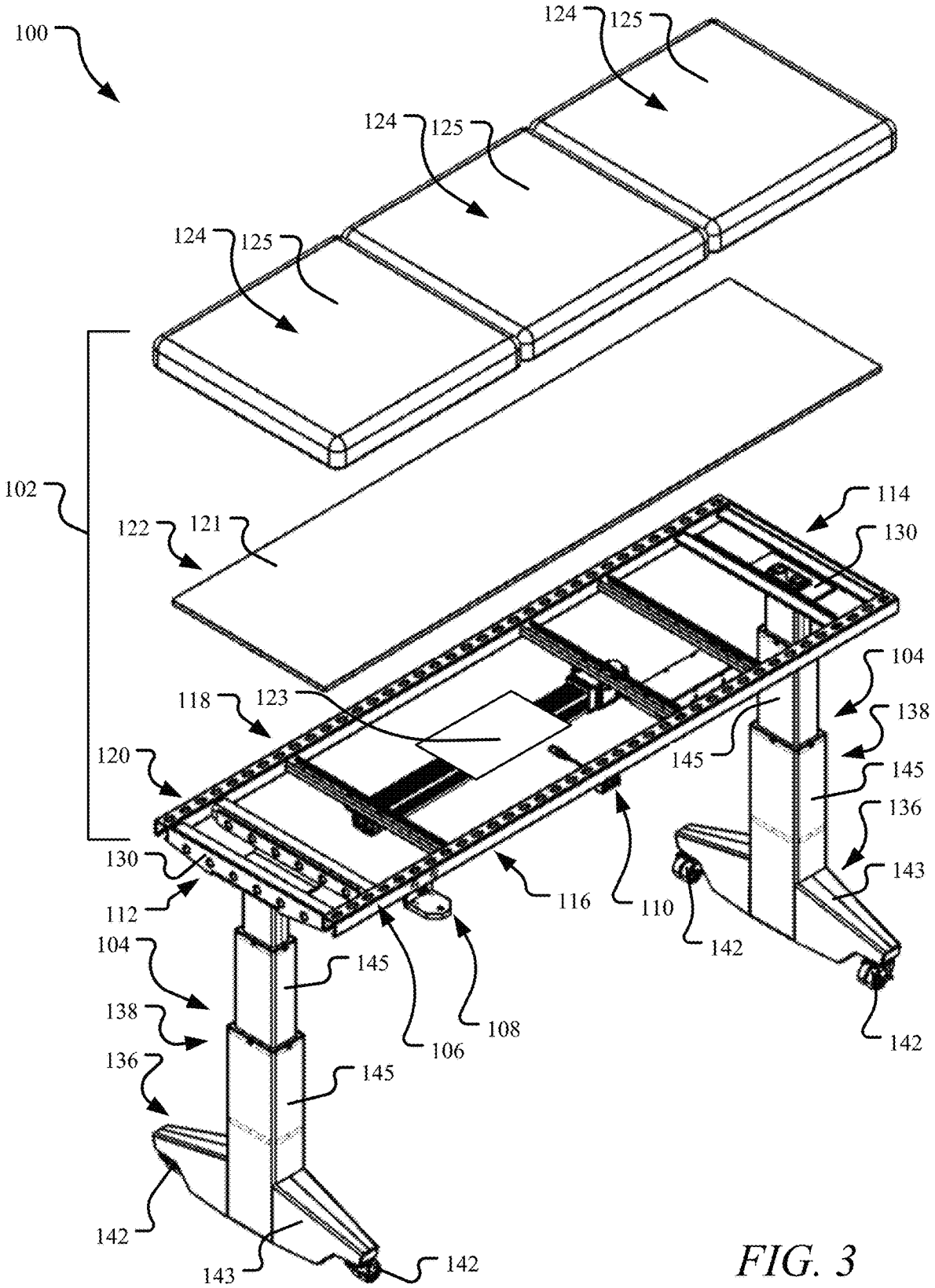
FIG. 3 illustrates the adjustable tattoo table in a partially exploded view to illustrate the platform.
Figure 4:
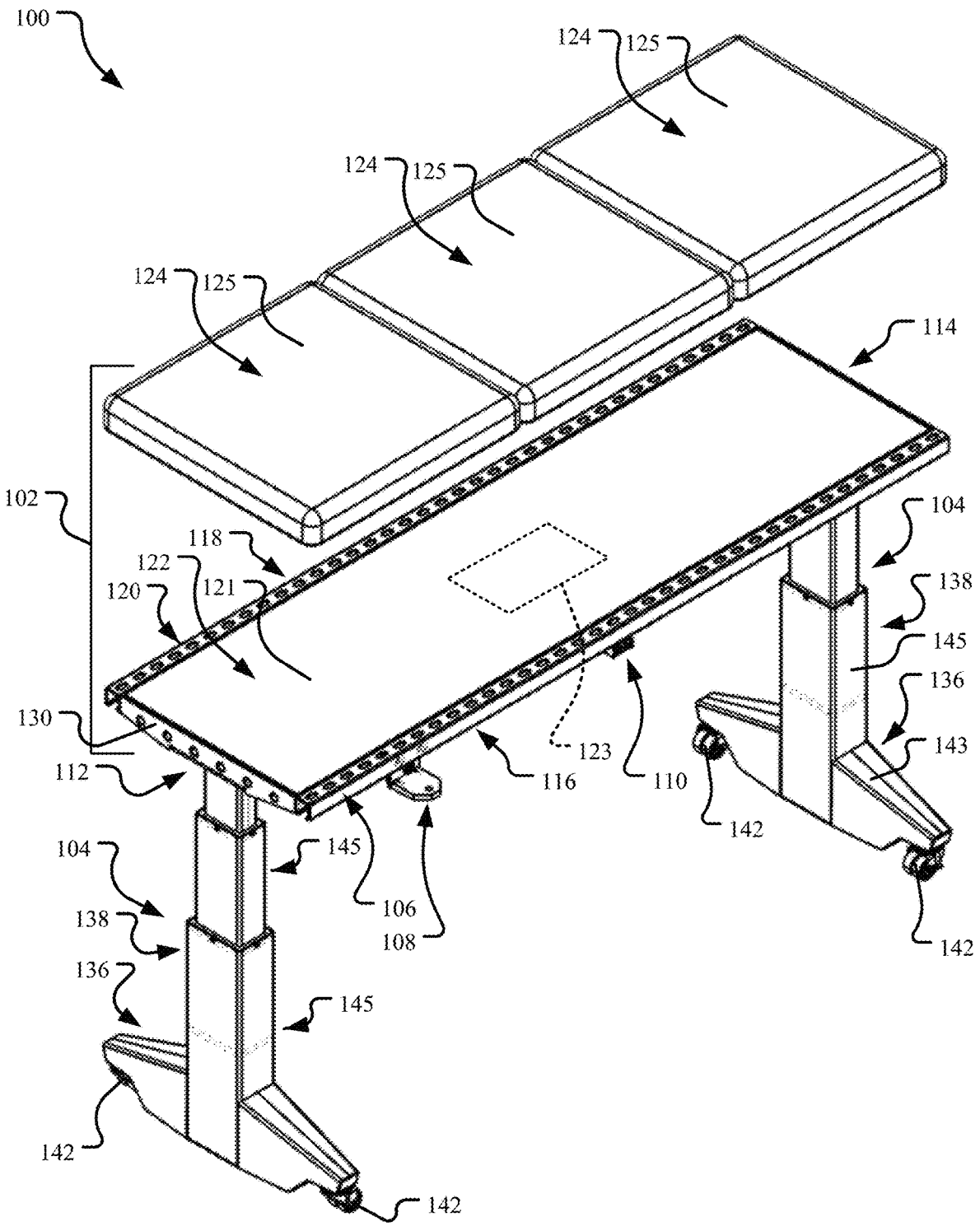
FIG. 4 illustrates the adjustable tattoo table in a partially exploded view to illustrate the platform.
Figure 5:
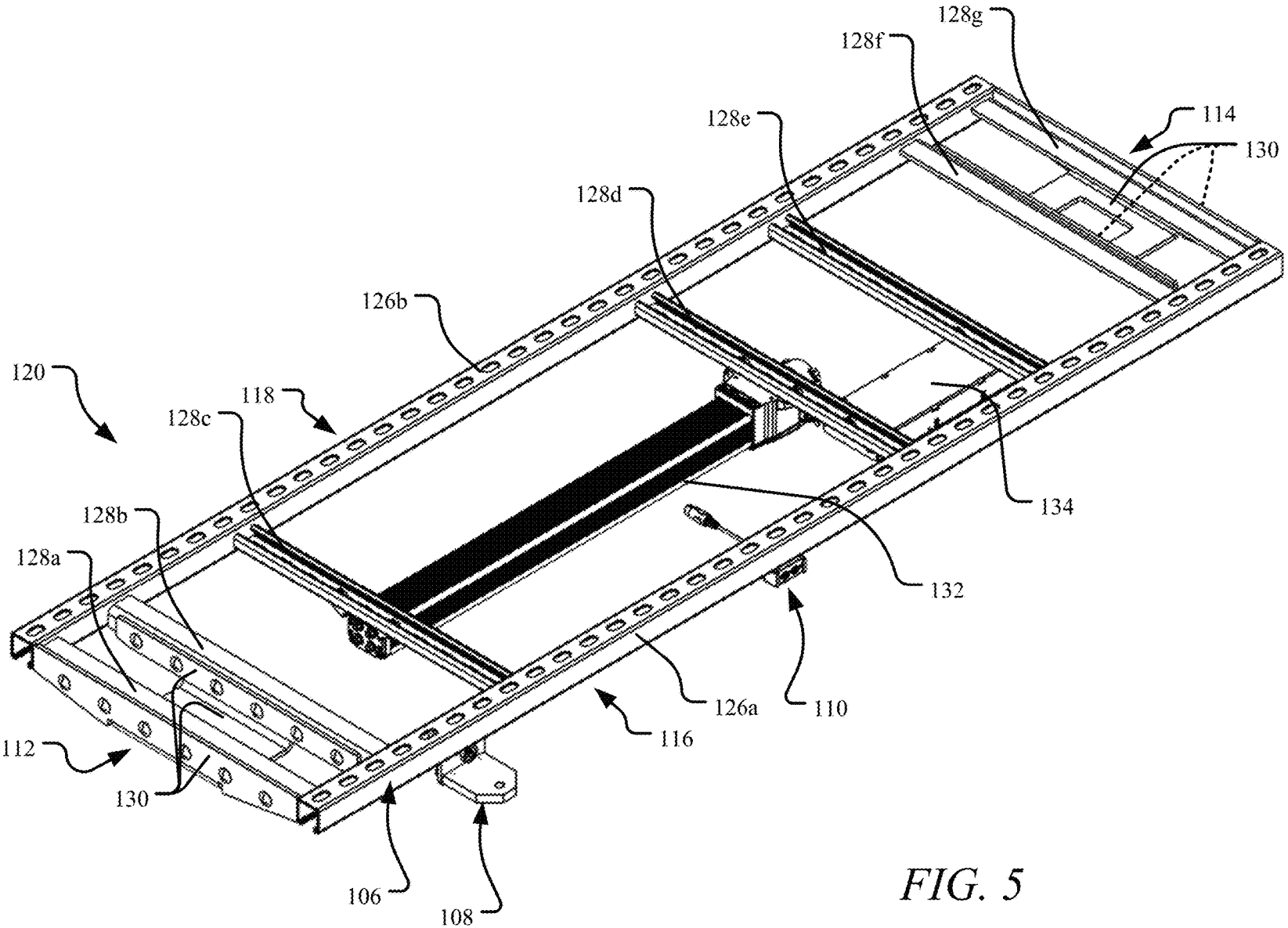
FIG. 5 illustrates a perspective view of the frame 120 of the platform 102.

Referring to FIGS. 3-5, the adjustable tattoo table 100 is illustrated in a first partially exploded view to illustrate the platform 102, a second partially exploded view to illustrate the platform 102, and a perspective view of the frame 120 of the platform 102. It should be noted that the lighting assembly 108 is only partially illustrated in FIGS. 3-5 (the articulating arms 162 and the light source 164 are not illustrated), to not obscure any portion of the platform 102.

Turning to the platform 102, the platform 102 extends from a left end 112 (e.g., first end) to a right end 114 (e.g., second end) opposite the left end 112. The distance between the left end 112 and the right end 114 defines a length of the platform 102. In some implementations, the length of the platform 102 is between 72-inches and 96-inches. In some examples, the length of the platform 102 is between 80-inches and 88-inches. In some examples, the length of the platform 102 is between 82-inches and 86-inches. In some examples, the length of the platform 102 is approximately 84-inches.

The platform 102 extends from a front end 116 (e.g., third end) to a back end 118 (e.g., fourth end) opposite the front end 116. The distance between the front end 116 and the back end 118 defines a width of the platform. In some implementations, the width of the platform 102 is between 20-inches and 40-inches. In some examples, the width of the platform 102 is between 24-inches and 36-inches. In some examples, the width of the platform 102 is between 28-inches and 32-inches. In some examples, the width of the platform 102 is approximately 30-inches.

The platform 102 includes a frame 120, a substrate 122, and a padded body 124, as illustrated for example in the partially exploded perspective views in FIGS. 3-4. When the adjustable tattoo table 100 is assembled, the substrate 122 is supported by the frame 120 and the padded body 124 is supported by the frame 120 and/or substrate 122. In other words, the frame 120 supports the substrate 122, which supports the padded body 124. The platform 102 (e.g., frame 120) is coupled to the adjustable supports 104, such that actuating the adjustable supports 104 causes the platform 102 to correspondingly raise or lower.

Turning to FIG. 5, which illustrates a perspective view of the frame 120, the frame 120 can include one or more longitudinal members 126 (e.g., longitudinal member 126*a*, longitudinal member 126*b*) and one or more lateral members 128 (e.g., lateral member 128*a*, lateral member 128*b*, lateral member 128*c*, lateral member 128*d*, lateral member 128*e*, lateral member 128*f*, lateral member 128*g*). In some implementations, the frame 120 (e.g., longitudinal members 126, lateral members 128) is constructed of metal. The lateral members 128 (also referred to as lateral supports) and the longitudinal members 126 (also referred to as longitudinal supports) are connected (e.g., welded) together to form the frame 120.

Each of the longitudinal members 126 can be an angle, channel, bar, or the like. For example, longitudinal member 126*a* and longitudinal member 126*b* are illustrated as channels (e.g., strut channels) with the channel opening facing downward. The horizontal portion of each channel includes apertures (e.g., holes, slots), which can receive fasteners (e.g., bolts, screws) therethrough. In some implementations, the support rail 106, which slidably supports the lighting assembly 108 (as previously discussed), can be part of the frame 120 of the platform 102. For example, one or more longitudinal members 126 (e.g., longitudinal member 126*a*) can function as the support rail 106. In one implementation, the longitudinal member 126*a* at the front end 116 of the platform 102 functions as the support rail 106.

Each of the lateral members 128 can be an angle, channel, bar, or the like. For example, lateral member 128*a*, lateral member 128*b*, lateral member 128*f*, and lateral member 128*g* are illustrated as angles. The angles include a horizontal portion and a vertical portion extending downward therefrom. The horizontal portion of each angle can support the substrate 122 and the vertical portion of each angle can be coupled (e.g., via a bracket 130) to the respective adjustable support 104. Each of lateral member 128*c*, lateral member 128*d*, and lateral member 128*e* are illustrated as channels (e.g., strut channels) with the channel opening facing upward. The horizontal portion of each channel includes apertures (e.g., holes, slots), which can receive fasteners (e.g., bolts, screws) therethrough. In some examples, the motor 132 and/or a processor 134 can be coupled to the respective lateral members 128 of the frame 120 by using a fastener connection.

Brackets 130 can couple the adjustable supports 104 to the frame 120 of the platform 102, as illustrated for example in FIG. 3. Each bracket 130 can include one or more vertical portion and a horizontal portion, as illustrated for example in FIG. 5. The vertical portions of each bracket 130 can be coupled to the respective lateral member 128 (e.g., the vertical portion of the angle of lateral member 128*a*, lateral member 128*b*, lateral member 128*f*, lateral member 128*g*). As non-limiting examples, the connections can be made via fastener (e.g., bolt, screw), such as illustrated in FIG. 5, or via weld, among others. The horizontal portion of each bracket 130 can include an opening that is sized and shaped to receive the adjustable support 104.

Each end of each of the lateral members 128 can be coupled (e.g., welded) to the longitudinal members 126 to form the frame 120 of the platform 102. The longitudinal members 126 and/or the lateral members 128 of the frame 120 support the substrate 122 thereon.

Returning to FIGS. 3-4, the substrate 122 is configured engage the frame 120, such that the frame 120 supports the substrate 122. The substrate 122 defines a top surface 121, which is configured to support the padded body 124 thereon. The top surface 121 of the substrate can be a planar surface. The plane defined by the planar surface of the top surface 121 can be parallel to the longitudinal axis LAP of the platform 102. In some instances, the substrate 122 is constructed of wood or metal. In other instances, the substrate 122 is constructed of a non-opaque (e.g., translucent, transparent material). As non-limiting examples of non-opaque materials, the substrate can be constructed of a polymer (e.g., plastic, acrylic) or a glass (e.g., tempered, laminated), among others.

A light source 123 can be included below the top surface 121 of the substrate 122, when the substrate 122 is constructed of a non-opaque material. When illuminated, the light source 123 can provide illumination through the non-opaque substrate 122. In some examples, the light source 123 can be below the substrate 122. In other examples, the light source 123 can be below the top surface 121 of the substrate 122 (e.g., embedded in the substrate 122).

In other words, the light source 123 (when illuminated) and the non-opaque substrate 122 (when exposed by removal of the padded body 124) can function as a light box, by backlighting the non-opaque substrate 122. In this manner, the adjustable tattoo table 100 can transition between a tattooing setup and a tracing setup (also referred to as a light box setup). In the tattooing setup, the padded body 124 is removably coupled to the substrate 122, as illustrated for example in FIG. 2, such that the artist can tattoo a person 10 thereon. In the tracing setup, the padded body 124 is removed (e.g., decoupled from the substrate 122) to expose the non-opaque substrate 122 and the light source 123 is illuminated (e.g., turned on). Then, the tattoo artist can use the top surface 121 of the substrate 122 to trace tattoo stencils or sketches, among others.

The padded body 124 (also referred to as a cushion) is configured to receive the person 10 thereon, as illustrated for example in FIG. 1. The padded body 124 can include more than one padded body 124. In some examples, as illustrated in FIGS. 1-4, the adjustable tattoo table 100 can include three separate padded bodies 124. In other examples, the adjustable tattoo table 100 can include one padded body 124, two padded bodies 124, or more than three padded bodies 124. Nevertheless, for the purposes of this disclosure, the padded body 124 is referred to in singular form. In some examples, the padded body 124 is covered with a medical grade upholstery (e.g., vinyl, faux leather, leather).

The padded body 124 defines a top surface 125, which supports the person 10. The top surface 125 of the padded body 124 can be a planar surface. The plane defined by the planar surface of the top surface 125 can be parallel to the longitudinal axis LAP of the platform 102. In some examples, the padded body 124 is high-density foam or high-resilience foam. The padded body 124 defines a thickness. In some implementations, the thickness of the padded body 124 is between 1-inch and 7-inches thick. In some examples, the thickness of the padded body 124 is between 3-inch and 5-inches thick. In some examples, the thickness of the padded body 124 is approximately 4-inches thick.

In some implementations, the padded body 124 is releasably secured (e.g., removably coupled) to the frame 120 and/or substrate 122. As non-limiting examples, the padded body 124 can be releasably secured to the frame 120 and/or substrate 122 via one or more sets of paired hook and loop fasteners, pins, snaps, magnets, or the like. For example, the padded body 124 can include one or more magnets and the frame 120 and/or substrate 122 can include one or more corresponding magnets such that the padded body 124 can be releasably secured to the frame 120 and/or substrate 122 via the one or more pairs of corresponding magnets. In some examples, the magnets can promote a cleaner environment (e.g., easier to clean) over other securing mechanisms (e.g., hook and loop fasteners). For example, the magnets can be internal to the padded body 124, the substrate 122, and/or the frame 120. In other implementations, the padded body 124 is fixed (e.g., coupled) to the frame 120 and/or substrate 122. As non-limiting examples, the padded body 124 can be fixed to the frame 120 and/or substrate 122 via sewing, adhesives, or the like.

Figure 8C:
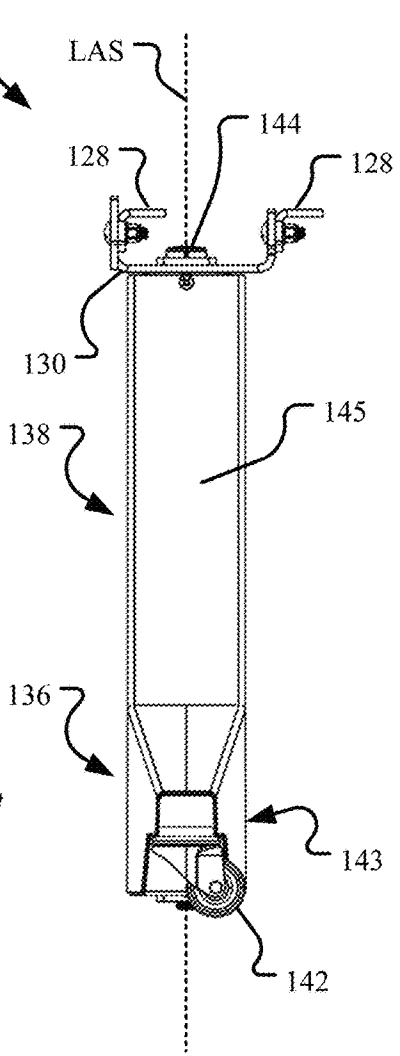
FIGS. 8A-8C illustrate a lowered or retracted position of an adjustable support in a perspective view, side view, and front view, respectively.
Figure 8B:
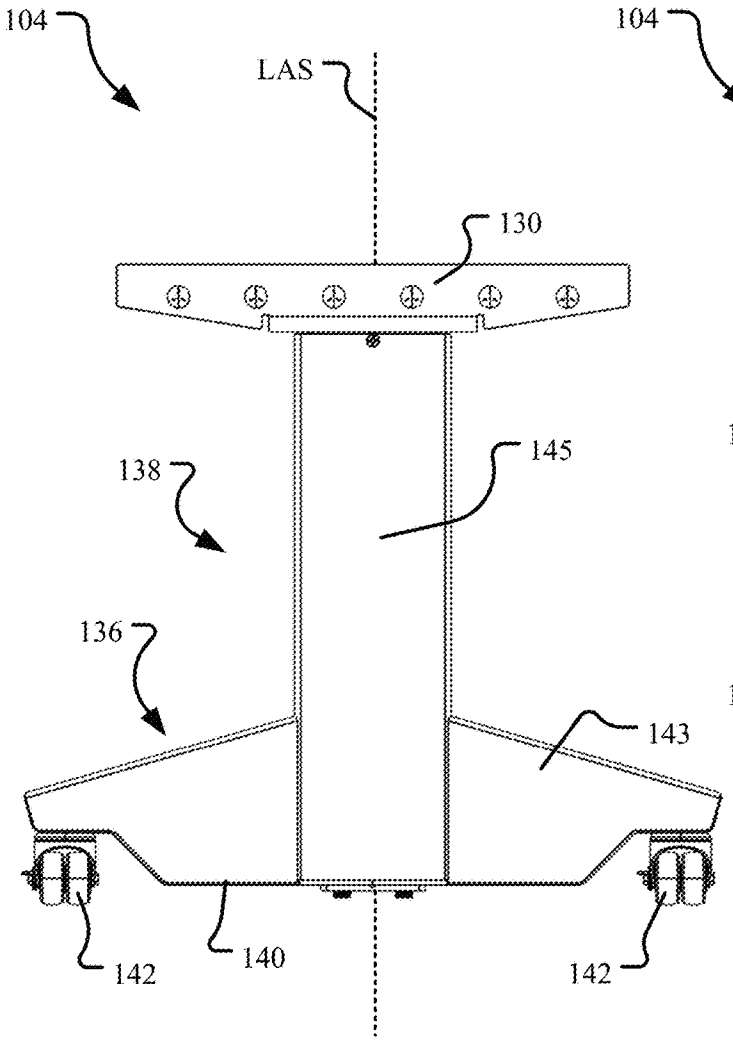
Figure 8A:
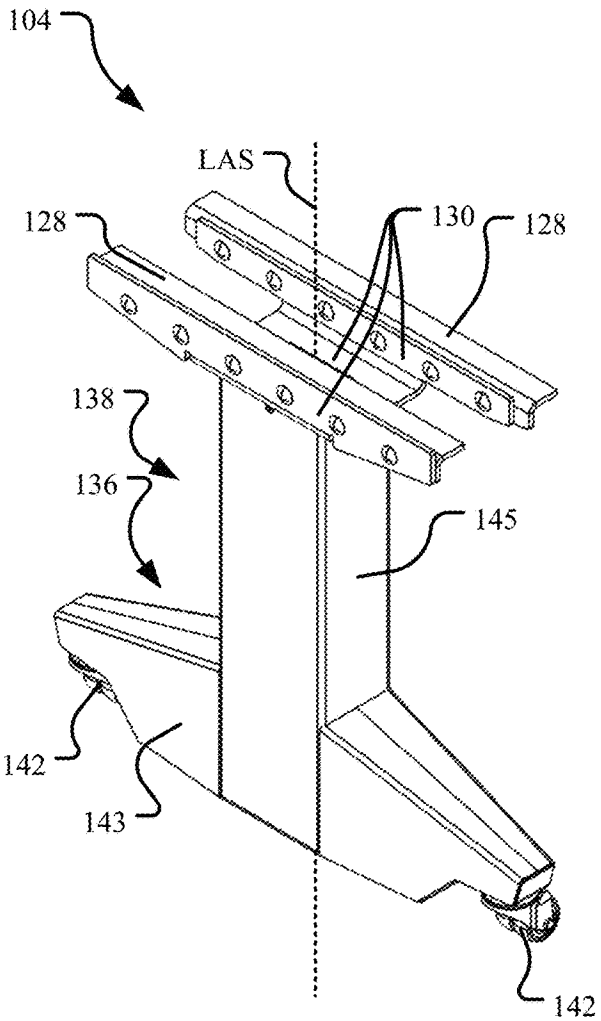
Figure 9:
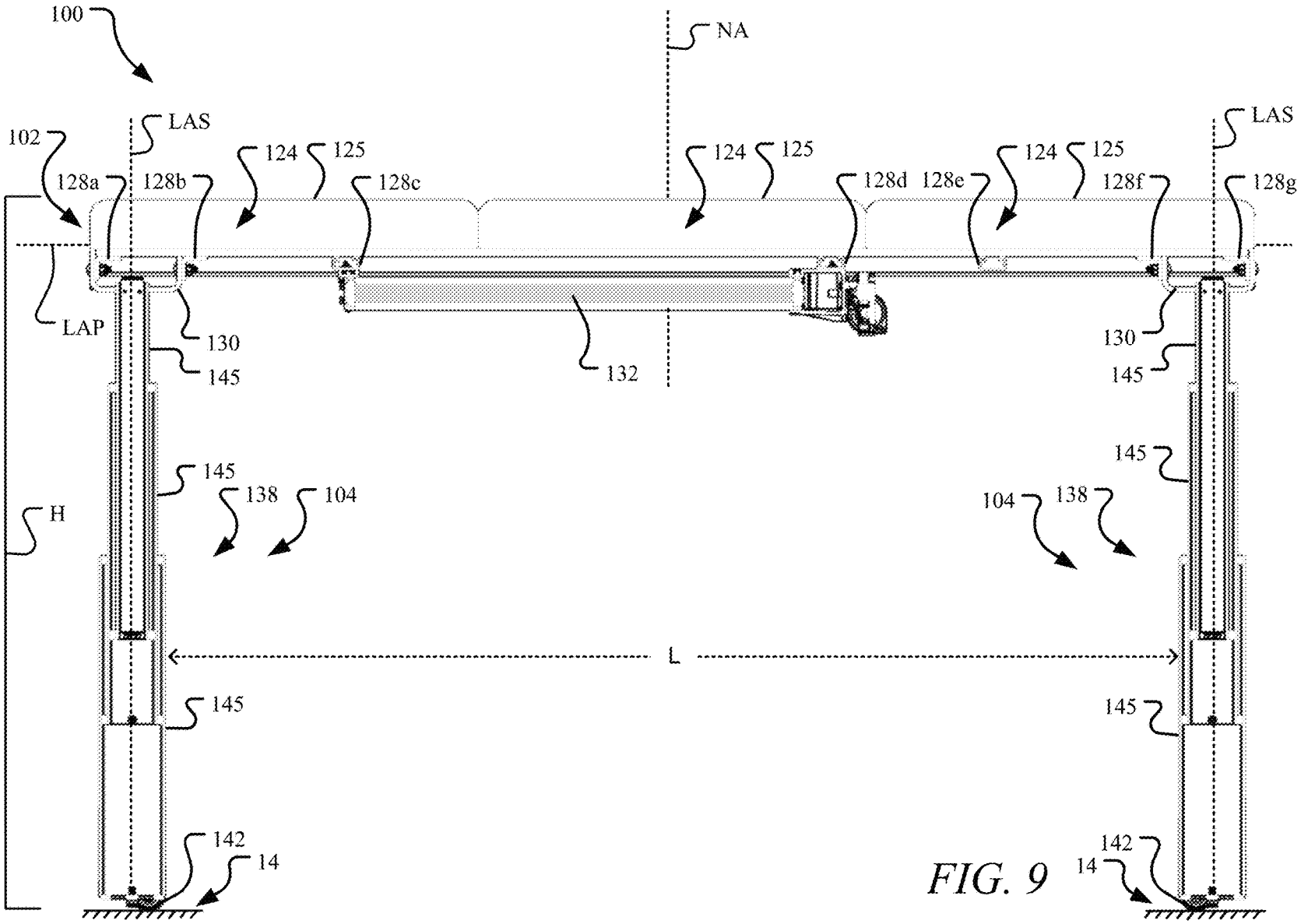
FIG. 9 illustrates the adjustable tattoo table in a cross-sectional view (the section line is illustrated on FIG. 2).
Figure 10:
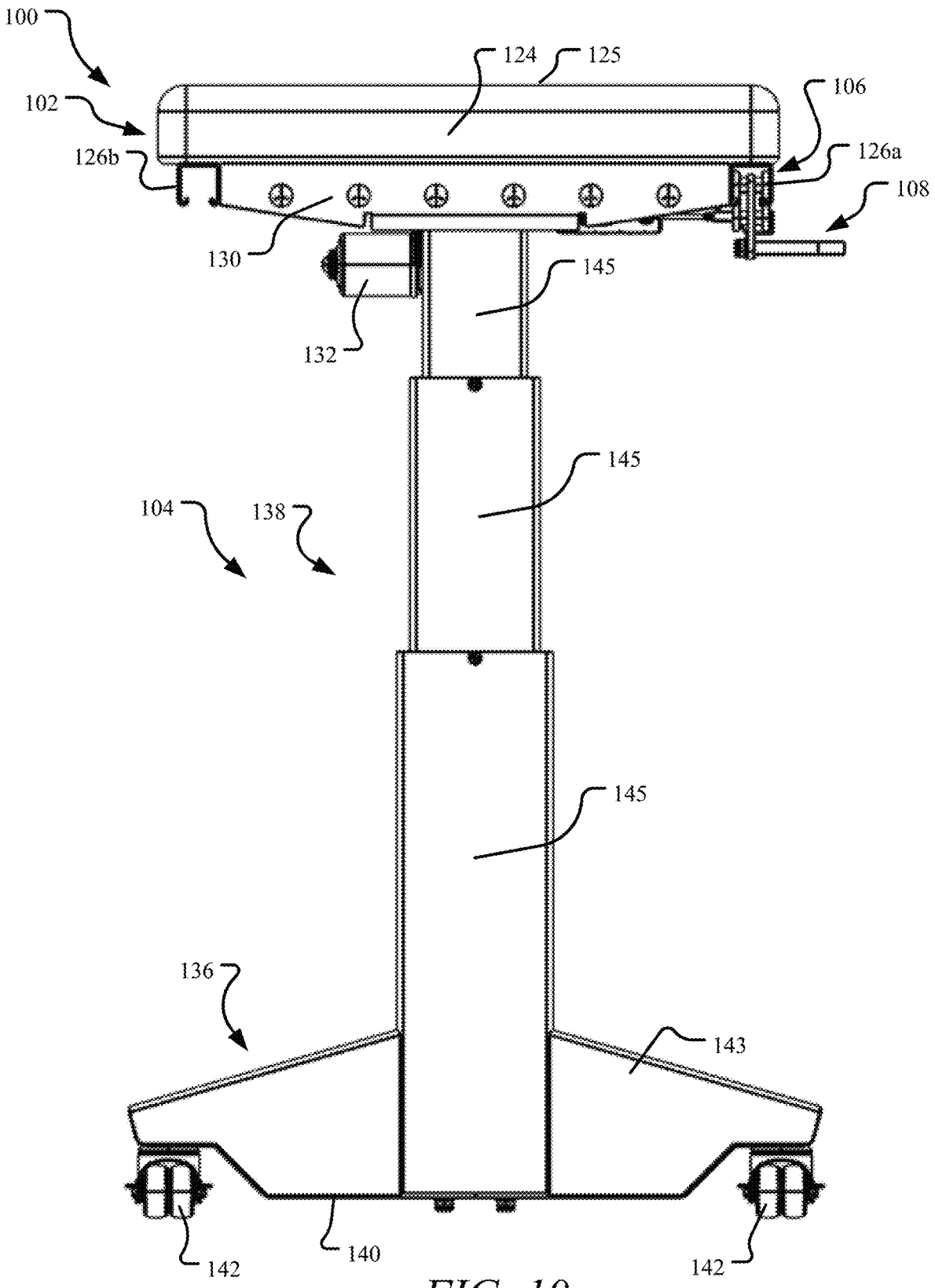
FIG. 10 illustrates a left-side view of the adjustable tattoo table.

Referring to FIGS. 6A-10, an adjustable support 104 of the tattoo table 100 is illustrated, according to one implementation in FIGS. 6A-8C. Additionally, the tattoo table 100 is illustrated in FIG. 9 in a cross-sectional view (the section line is illustrated on FIG. 2) to further illustrate the adjustable supports 104. The adjustable support 104 includes a base portion 136 and an adjustable portion 138. The base portion 136 supports the adjustable portion 138. The adjustable portion 138 is configured to extend or retract, thereby changing the length of the adjustable portion 138 (and correspondingly changing the height H of the platform 102 as illustrated for example in FIG. 1). The adjustable support 104 is illustrated in a raised position (also referred to as an extended position) in a perspective view, side view, and front view, respectively, in FIGS. 6A-6E. The adjustable support 104 is illustrated in an intermediate position in a perspective view, side view, and front view, respectively, in FIGS. 7A-7C. The adjustable support 104 is illustrated in a lowered position (also referred to as a retracted position) in a perspective view, side view, and front view, respectively, in FIGS. 8A-8C.

Figure 6C:
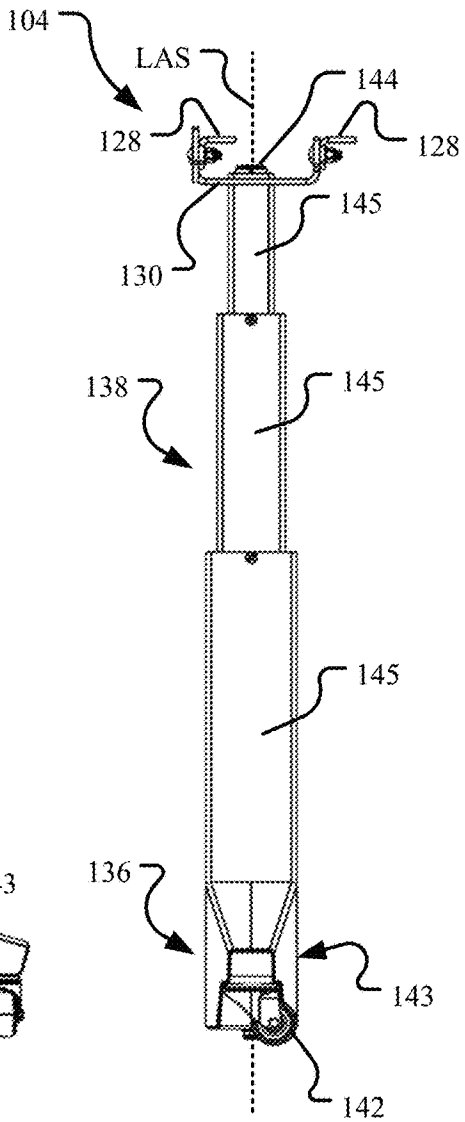
FIGS. 6A-6E illustrate a raised or extended position of an adjustable support in a perspective view, a partially transparent side view, and a front view, respectively.
Figure 6B:
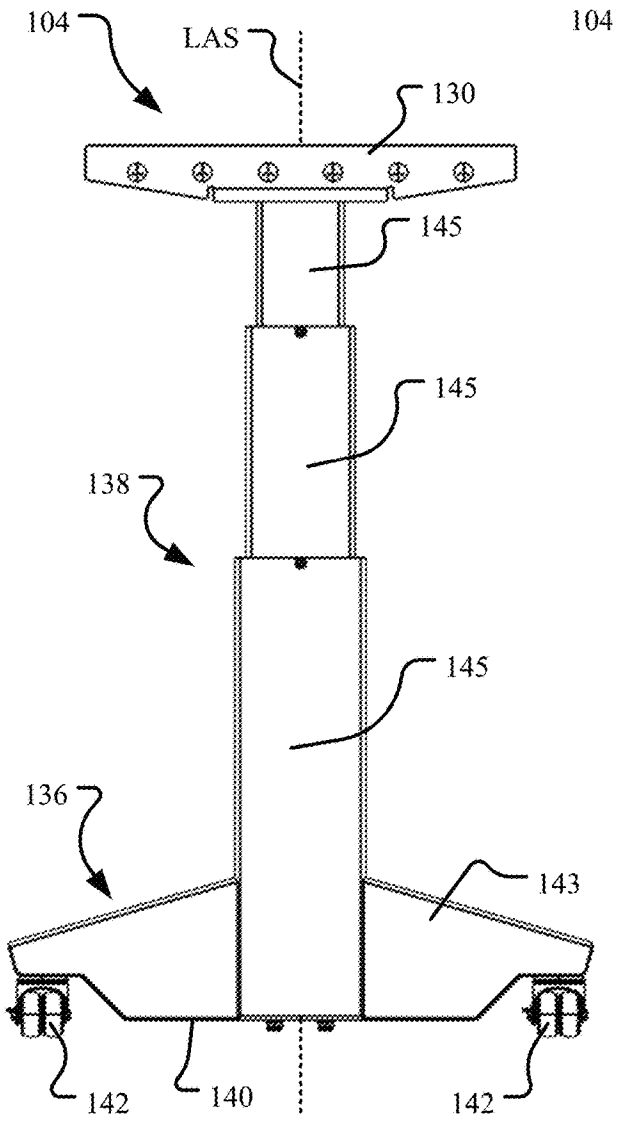
Figure 6A:
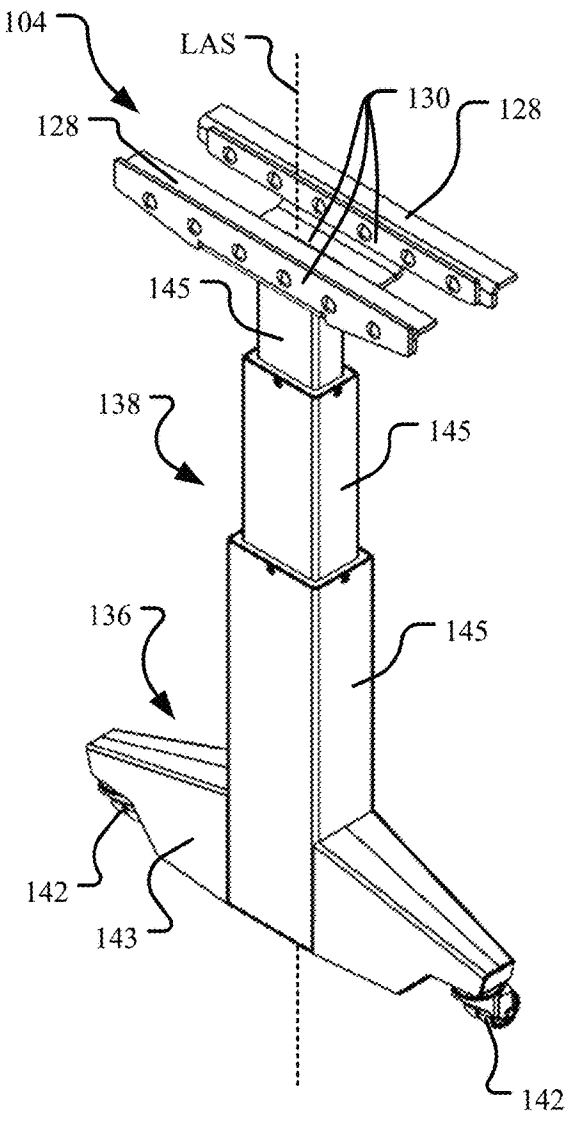
Figure 6E:
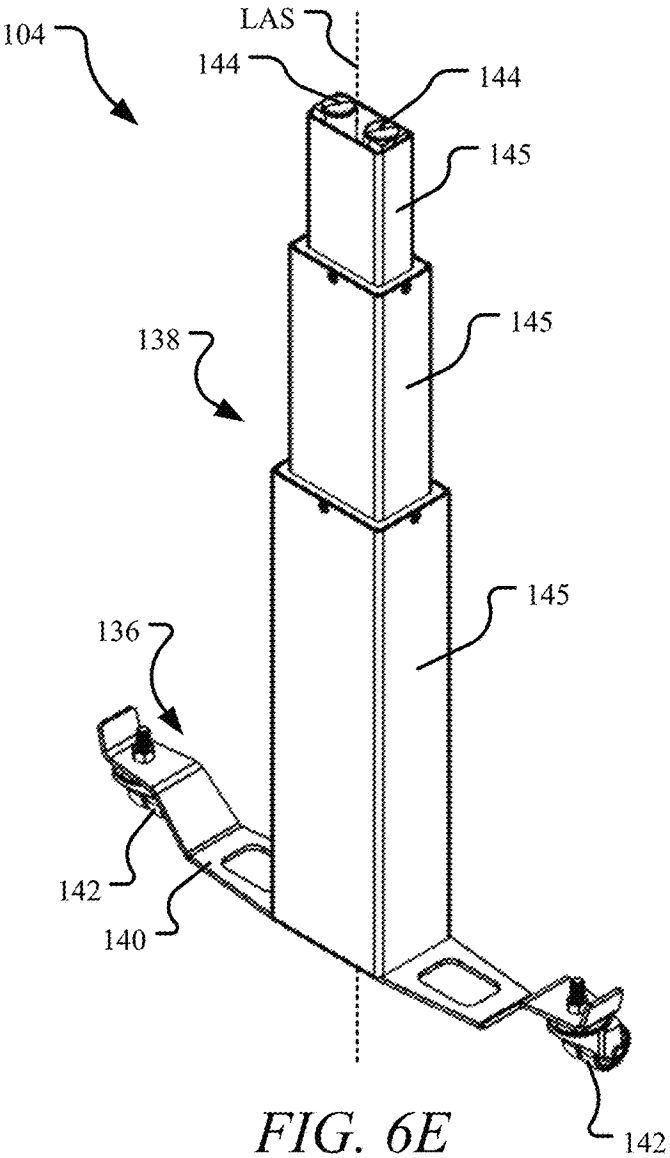

The base portion 136 includes a base 140 and, in some implementations, the base portion 136 also includes wheels 142 and/or a cover 143. The base 140 (of the base portion 136) supports the adjustable portion 138, which is discussed below. The base 140 is illustrated in FIG. 6E (which is illustrated with the cover 143 removed from base portion 136), according to one implementation. The base 140 can include one or more substantially horizontal portions. For example, a substantially horizontal portion of the base 140 can support the adjustable portion 138. In some implementations, wheels 142 (e.g., casters) extend downward from the base 140 and are configured to contact the ground 14 (as illustrated for example in FIG. 9). When the wheels 142 are in contact with the ground 14, the wheels 142 support the base 140. Then, the tattoo table 100 can be moved (e.g., translated, rotated) on the ground 14 via the wheels 142. A cover 143 can cover or otherwise enclose the base portion 136 (or a portion thereof), as illustrated for example in FIGS. 6A-6D. In one implementation, the cover 143 encloses the upper-facing portions of the base 140 and fasteners of the wheels 142 (which are illustrated in FIG. 6E).

The adjustable portion 138 is coupled to the base portion 136 and extends upward. The adjustable portion 138 defines a longitudinal axis LAS of the adjustable support 104. When the adjustable tattoo table 100 is assembled, as illustrated for example in FIG. 9, the longitudinal axis LAS of each of the adjustable supports 104 are substantially parallel. Moreover, when the adjustable tattoo table 100 is on a substantially horizontal surface (e.g., ground 14), the longitudinal axis LAS of each of the adjustable supports 104 is substantially vertical. The adjustable portion 138 of the adjustable support 104 is configured to expand or retract along the longitudinal axis LAS, thereby raising or lowering the height of the adjustable support 104. This, in turn, raises or lowers the height H of the platform 102. As the platform 102 is raised or lowered, the longitudinal axis LAS of each of the adjustable supports 104 remain both substantially parallel and substantially vertical.

Figure 6D:
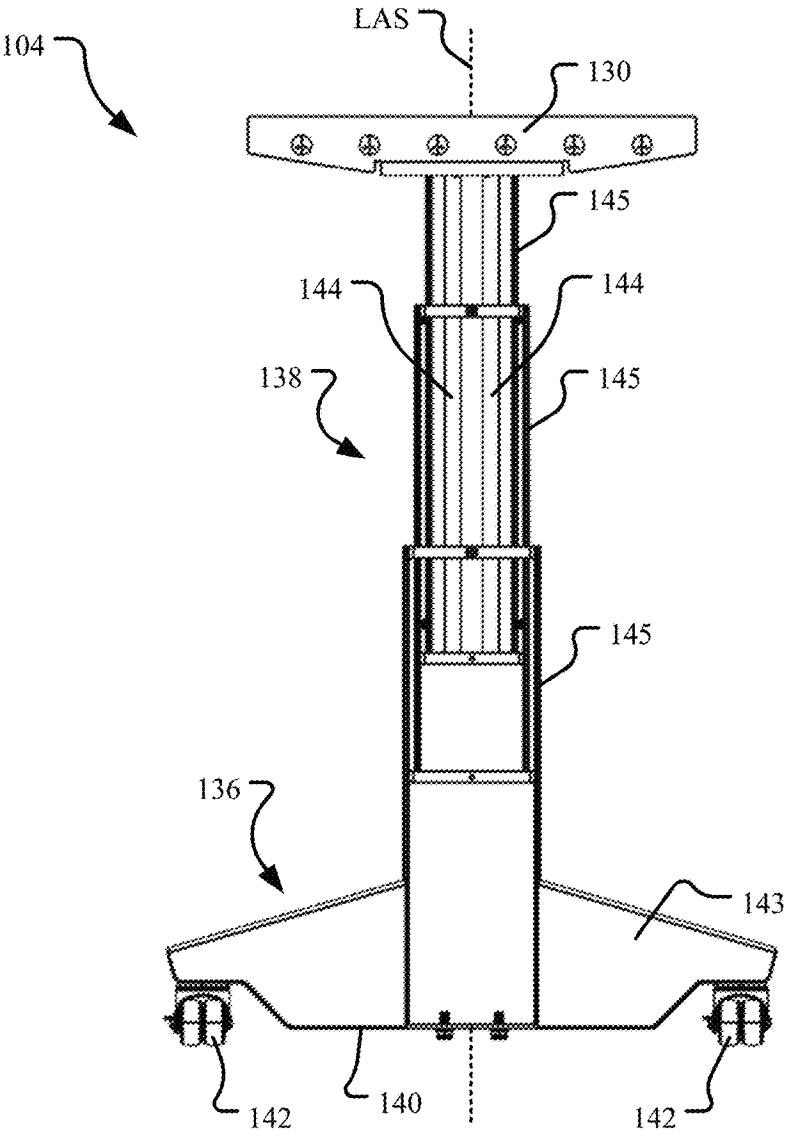
Figure 7C:
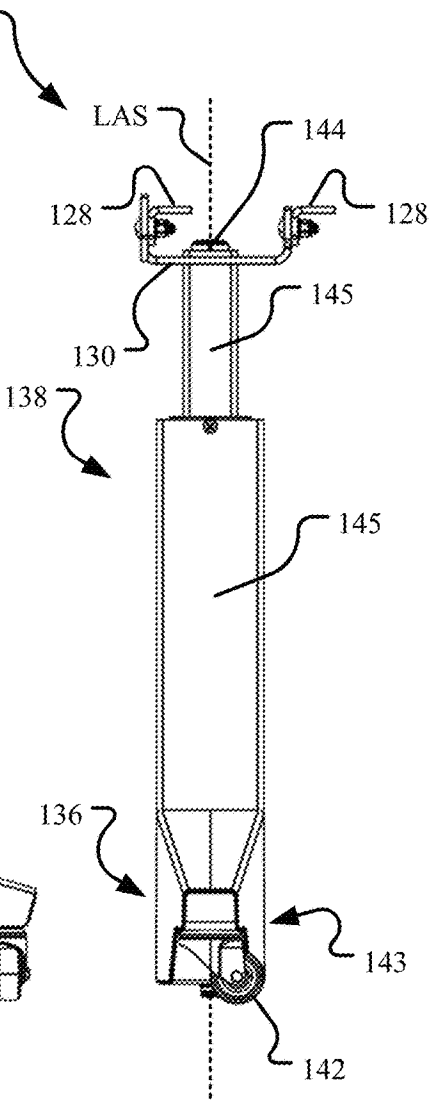
FIGS. 7A-7C illustrate an intermediate position of an adjustable support in a perspective view, side view, and front view, respectively.
Figure 7B:
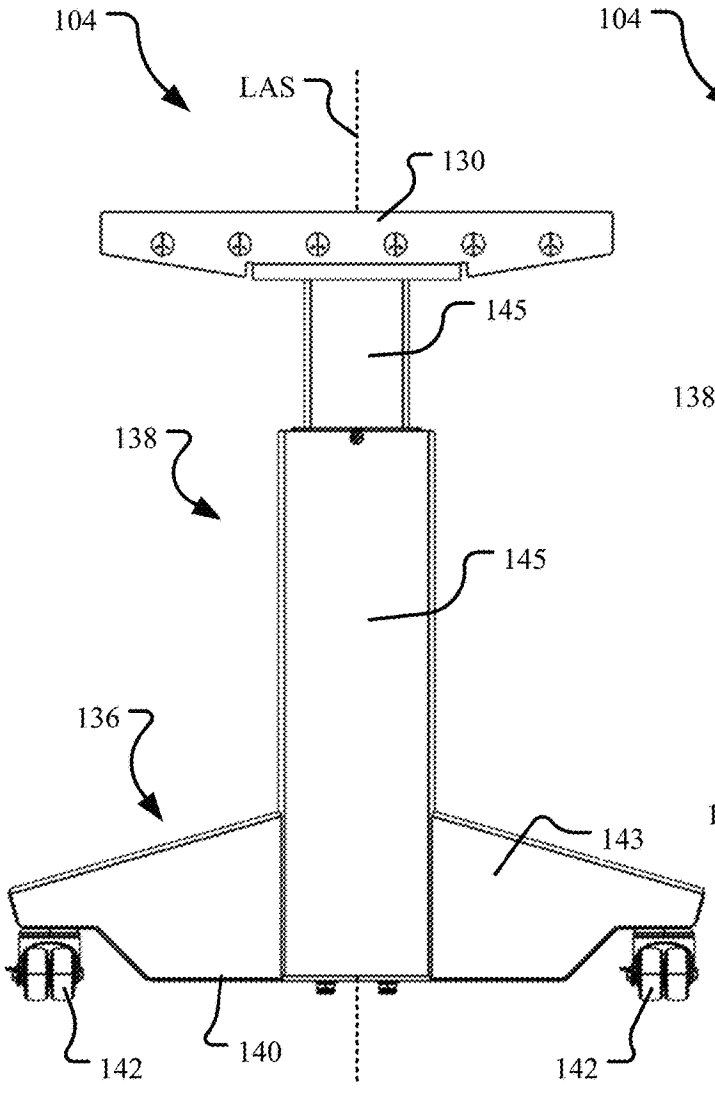
Figure 7A:
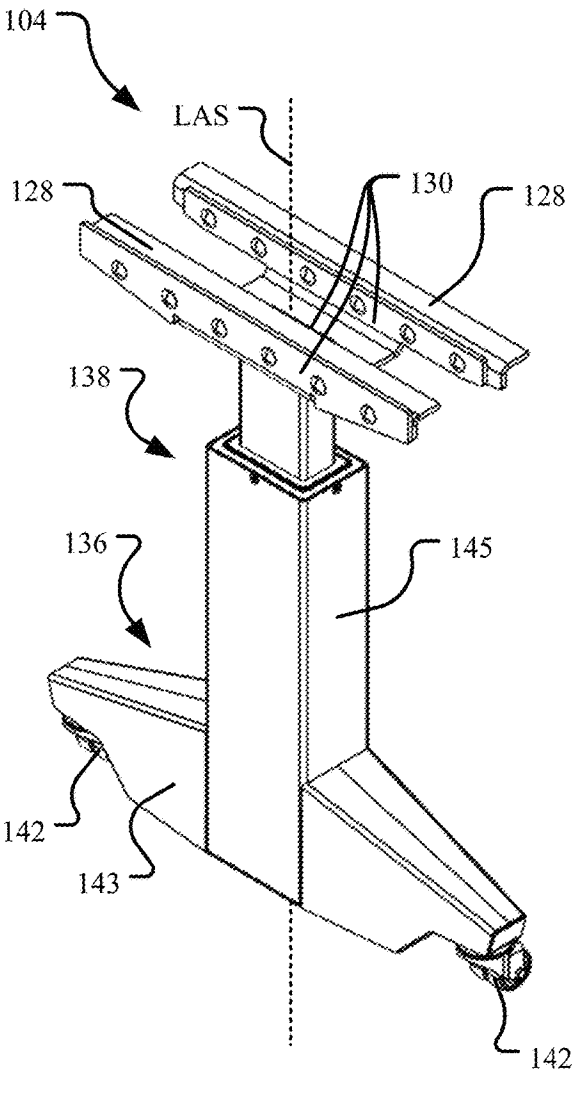

As illustrated in FIG. 6D (which illustrated the cover sections 145 as transparent), the adjustable portion 138 can include one or more actuators 144 (e.g., linear actuators). In some implementations, the actuators 144 are hydraulic actuators. In some examples, as illustrated in FIG. 6D, the adjustable portion 138 can include two actuators 144. In other examples, the adjustable portion 138 includes one actuator 144. In still other examples, the adjustable portion 138 includes three or more actuators 144. In some implementations, the actuators 144 are linear actuators, as illustrated for example in FIG. 6D. Each linear actuator is configured to expand or retract along a longitudinal axis of the linear actuator, which is parallel to (or in some cases colinear with) the longitudinal axis LAS of the adjustable support 104.

The adjustable portion 138 can include two or more cover sections 145, which cover or otherwise enclose the one or more actuators 144. In some implementations, the cover sections 145 are telescoping. That is, each of the cover sections 145 pertaining to an adjustable support 104 defines a different cross-sectional dimension such that the cover sections 145 are nested together. In this manner, the cover sections 145 telescope outward (e.g., apart) when the adjustable portion 138 extends. Similarly, the cover sections 145 telescope inward (e.g., together) when the adjustable portion 138 retracts. Thus, the adjustable supports 104 can include telescoping tubes that are configured to simultaneously extend or retract. In some examples, as illustrated in the figures, the cover sections 145 are tubes having a rectangular cross-section. The cover sections 145 can be made of metal (e.g., steel).

The adjustable portion 138 of the adjustable support 104 is coupled to the bracket 130. As previously discussed, the bracket 130 can be coupled to the lateral members 128 of the frame 120. In this manner, the adjustable support 104 is coupled to the platform 102, as illustrated for example in FIG. 9.

As illustrated in FIGS. 6A-8C, the adjustable support 104 can be extended or retracted along the longitudinal axis LAS. The adjustable support 104 can be retracted from a raised or extended position (as illustrated in FIGS. 6A-6E) to a lowered or retracted position (as illustrated in FIGS. 8A-8C). Similarly, the adjustable support 104 can be extended from a lowered position (as illustrated in FIGS. 8A-8C) to a raised position (as illustrated in FIGS. 6A-6E). Moreover, the adjustable support 104 can be adjusted to various intermediate positions (as illustrated for example in FIGS. 7A-7C).

Figure 11:
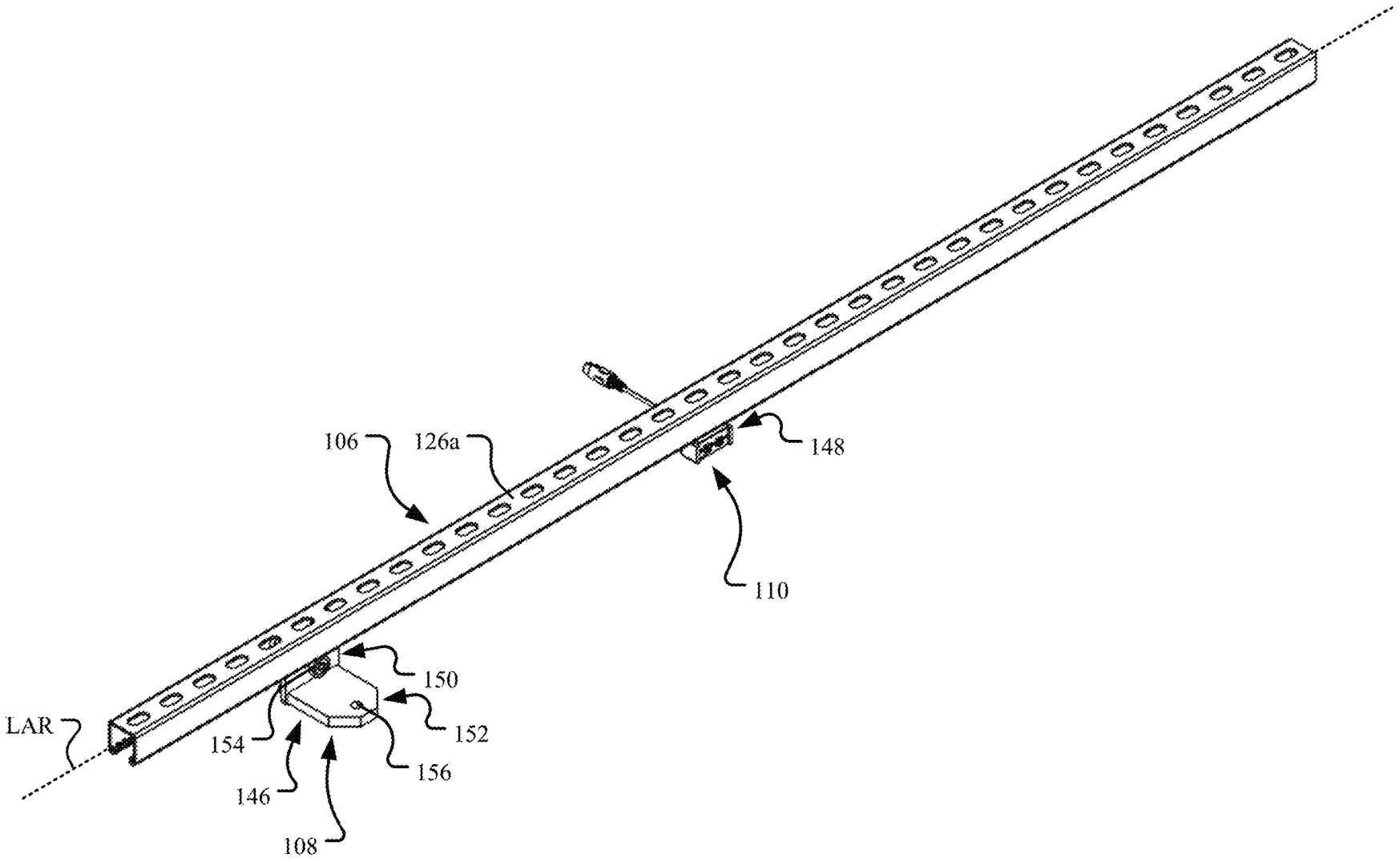
FIG. 11 illustrates a perspective view of the support rail with a portion of a lighting assembly and a controller slidably engaged.
Figure 12C:
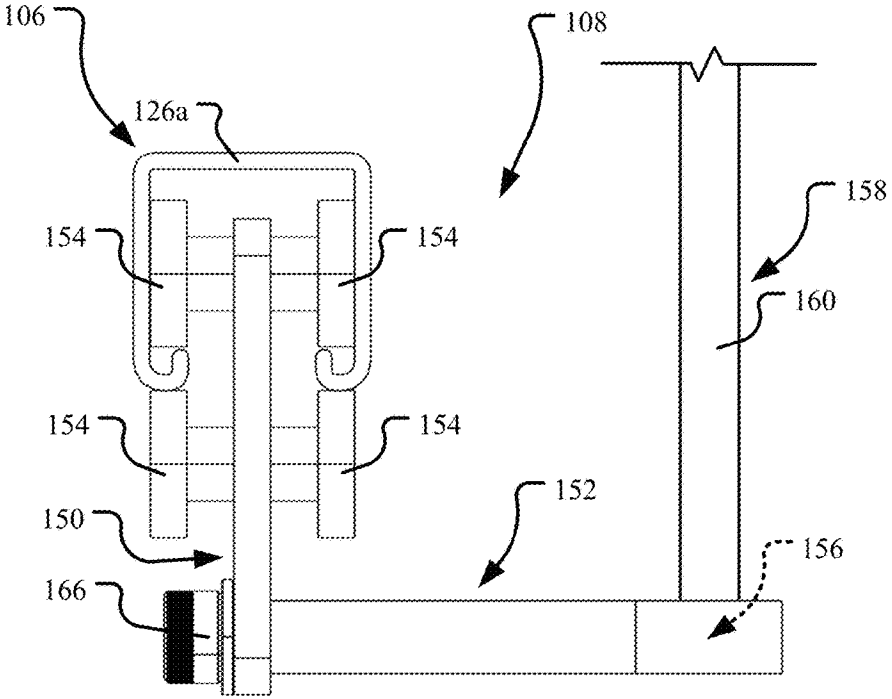
FIGS. 12A-12C illustrate the slidable mount of the lighting assembly in a front perspective view, rear perspective view, and side view, respectively.
Figure 12A:
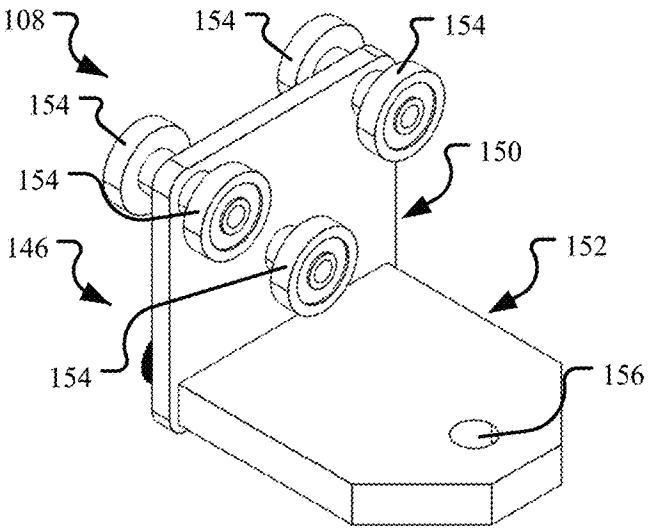
Figure 12B:
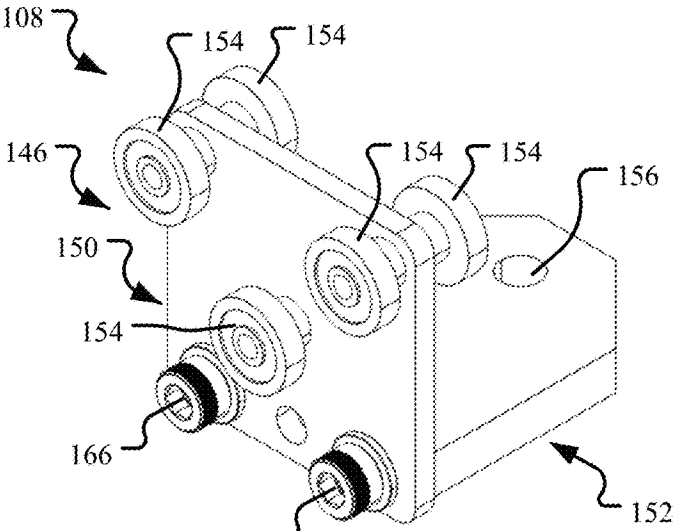
Figure 13C:
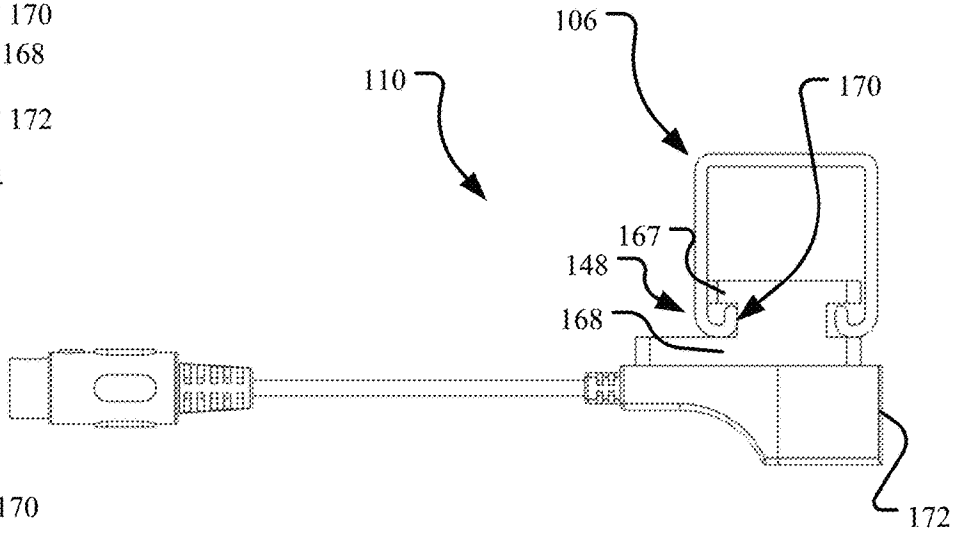
FIGS. 13A-13C illustrate the slidable mount of the controller in a front perspective view, rear perspective view, and side view, respectively.

Referring to FIGS. 10-13C, the support rail 106 can slidably support a lighting assembly 108 and a controller 110. The adjustable tattoo table 100 is illustrated in a left-side view in FIG. 10, and a perspective view of the support rail 106 is illustrated in FIG. 11, according to one implementation. The lighting assembly 108 and the controller 110 slidably are engaged to the support rail 106, such that the positions of the lighting assembly 108 and/or controller 110 can be slidably adjusted (e.g., translated) along the support rail 106. The slidable mount 146 of the lighting assembly 108 is illustrated in FIGS. 12A-12C in a front perspective view, rear perspective view, and side view, respectively. The slidable mount 148 of the controller 110 is illustrated in FIGS. 13A-13C in a front perspective view, rear perspective view, and side view, respectively.

In some implementations, one or more components of the slidable mount 146 of the lighting assembly 108 (as discussed below with respect to FIGS. 12A-12C) are interchangeable with one or more components of the slidable mount 148 of the controller 110 (as discussed below with respect to FIGS. 13A-13C). That is, the slidable mount 146 of the lighting assembly 108 can include one or more of the same or similar features, components, or elements as the slidable mount 148 of the controller 110. Similarly, the slidable mount 148 of the controller 110 can include one or more of the same or similar features, components, or elements as the slidable mount 146 of the lighting assembly 108.

Turning to FIG. 11, the support rail 106 defines a longitudinal axis LAR. The lighting assembly 108 and/or controller 110 can be translated (e.g., slid) along the longitudinal axis LAR of the support rail 106. It should be noted that the lighting assembly 108 is only partially illustrated in FIG. 11 (the articulating arms 162 and the light source 164 are not illustrated).

In some implementations, the longitudinal axis LAR of the support rail 106 is substantially parallel to the longitudinal axis LAP of the platform 102, as illustrated for example in FIG. 2. Thus, when the adjustable tattoo table 100 is on a substantially horizontal surface (e.g., ground 14), as illustrated for example in FIG. 1, the longitudinal axis LAR of the support rail 106 (as illustrated in FIG. 11) can be substantially horizontal. Additionally, the longitudinal axis LAR of the support rail 106 (as illustrated in FIG. 11) can be substantially perpendicular to the longitudinal axis LAS of the adjustable supports 104 (as illustrated in FIG. 1).

The support rail 106 is coupled to the platform 102, such that when the platform 102 is raised or lowered the support rail 106 correspondingly raises or lowers. As a result, the tattoo artist may be able to adjust the height H of the platform 102 without having to make an adjustment to the position of the lighting assembly 108.

In some implementations, the support rail 106 is incorporated into the frame 120 of the platform 102, as illustrated for example in FIG. 5. For example, the support rail 106 can be a longitudinal member 126 (e.g., longitudinal member 126*a*) of the frame 120. In some aspects, the support rail 106 is on the front end 116 of the platform 102 such that the lighting assembly 108 and/or controller 110 are slidable along the front end 116. In this manner, the support rail 106 and the corresponding lighting assembly 108 and/or controller 110 are conveniently accessible for the tattoo artist. In some implementations, the support rail 106 is a channel (e.g., strut channel).

Turning to FIGS. 12A-12C, the slidable mount 146 of the lighting assembly 108 is illustrated in a front perspective view, rear perspective view, and side view, respectively. The slidable mount 146 of the lighting assembly 108 is configured to slidably engage the support rail 106, as illustrated for example in the perspective overview in FIG. 11 and the detailed side view in FIG. 12C. In some implementations, the slidable mount 146 includes a vertical portion 150 and a horizontal portion 152. For example, the vertical portion 150 extends vertically downward from the support rail 106 and the horizontal portion 152 extends horizontally outward therefrom. In some aspects, when the slidable mount 146 of the lighting assembly 108 is slidably engage the support rail 106, the a plane defined by the vertical portion 150 is substantially vertical and a plane defined by the horizontal portion 152 is substantially horizontal.

The vertical portion 150 can include one or more wheels 154 configured to rotatably interact with the support rail 106, as illustrated for example in FIG. 12C. In this manner, the slidable mount 146 can slide along an axis that is parallel to the longitudinal axis LAR of the support rail 106 (illustrated in for example in FIG. 11). In some implementations, the support rail 106 is a channel (e.g., strut channel). One or more pairs of wheels 154 can be received within the channel of the support rail 106. Similarly, one or more pairs of wheels 154 can be outside the channel, while abutting the support rail 106. The abutting surfaces can inhibit wobble of the slidable mount 146 as it translates along the support rail 106.

The horizontal portion 152 can include an aperture 156 configured to receive a light frame 158 therein, such that the horizontal portion 152 supports the light frame 158. The light frame 158 can include a vertical portion 160 (as illustrated in FIG. 12C) and one or more articulating arms 162 (as illustrated for example in FIG. 1) extending therefrom.

Turning briefly to FIG. 1, a light source 164 can be coupled to the one or more articulating arms 162. The articulating arms 162 can articulate with respect to each other, such that the position of the light source 164 can be adjusted by articulating one or more of the articulating arms 162. When the light source 164 is illuminated (e.g., turned on), the light source 164 can supply light 16 to at least a portion of a working area, such as the body 12 (or portion of the body 12) of the person 10 that is being tattooed.

Returning to FIGS. 12A-12C, in some implementations, the vertical portion 150 and the horizontal portion 152 of the slidable mount 146 of the lighting assembly 108 can be removably coupled together with one or more fasteners 166 (e.g., bolt, screw). That is, the fasteners 166 can be release or otherwise removed such that the horizontal portion 152 can be decoupled from the vertical portion 150.

Figure 13A:
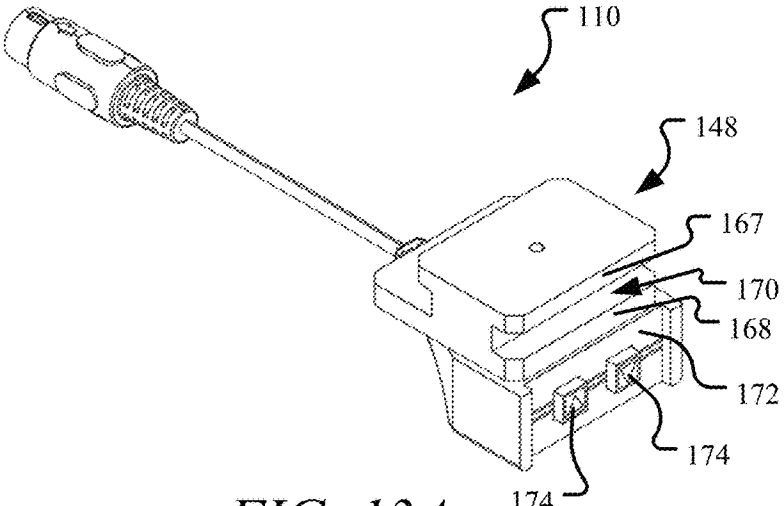
Figure 13B:
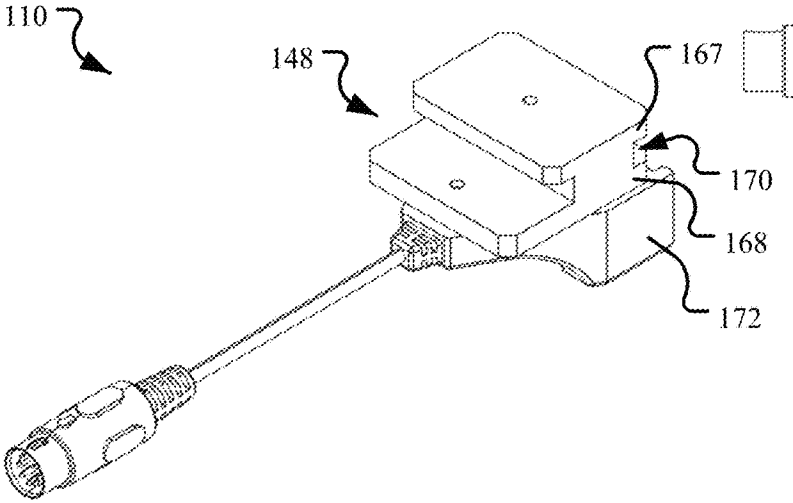

Turning to FIGS. 13A-13C, the slidable mount 148 of the controller 110 is illustrated in a front perspective view, rear perspective view, and side view, respectively. The slidable mount 148 of the controller 110 is configured to slidably engage the support rail 106, as illustrated for example in the perspective overview in FIG. 11 and the detailed side view in FIG. 13C. In some implementations, the slidable mount 148 includes a top portion 167 and a bottom portion 168 that extends downward from the top portion 167. In some aspects, a channel 170 is defined between the top portion 167 and bottom portion 168. The top portion 167 can be received within the channel of the support rail 106 and the bottom portion 168 can be outside the channel.

Portions of the top portion 167, the channel 170, and the bottom portion 168 can abut the channel of the support rail 106 as the slidable mount 148 of the controller 110 translates (e.g., slides) along the support rail 106. More particularly, the top portion 167 can include a horizontal surface configured to slidably abut the support rail 106. Similarly, the bottom portion 168 can include a horizontal surface configured to slidably abut the support rail 106. The channel 170 can include a vertical surface configured to slidably abut the support rail 106. The abutting surfaces can inhibit wobble of the slidable mount 148 as it translates along the support rail 106.

A control portion 172 extends from the slidable mount 148 of the controller 110 and includes one or more controls 174 thereon. The controls 174 can include, for example, buttons, switches, knobs, dials, levers, or the like.

In some aspects, the controls 174 can control the height of the platform 102. That is, the controller 110 (e.g., the corresponding controls 174) and/or processor 134 can be in communication with the adjustable supports 104 (e.g., via the motor 132). In turn, the motor 132 can cause the adjustable supports 104 to extend or retract. The controls 174 can be actuated to actuate the adjustable supports 104 and correspondingly raise or lower the height of the platform 102. In some aspects, the controls 174 include a safety for the height control. That is, unless the safety is actuated prior to actuation of the control 174 for the height of the platform 102, the safety inhibits or otherwise prevents raising or lowering height of the platform 102 (e.g., inhibits actuation of the adjustable supports 104).

In some aspects, the controls 174 can control the illumination of the light source 164 (of the lighting assembly 108). That is, the controller 110 (e.g., the corresponding controls 174) and/or processor 134 can be in communication with the light source 164. The controls 174 can be actuated to cause the light source 164 to transition between on (e.g., illuminating) or off. Additionally, the controls 174 can be actuated to cause the light source 164 to cause the intensity of the light source 164 to transition between brighter or dimmer.

In some aspects, the controls 174 can control the illumination of the light source 123 (e.g., pertaining to the light box). That is, the controller 110 (e.g., the corresponding controls 174) and/or processor 134 can be in communication with the light source 123. The controls 174 can be actuated to cause the light source 123 to transition between on (e.g., illuminating) or off. Additionally, the controls 174 can be actuated to cause the light source 164 to cause the intensity of the light source 164 to transition between brighter or dimmer.

Figure 14:
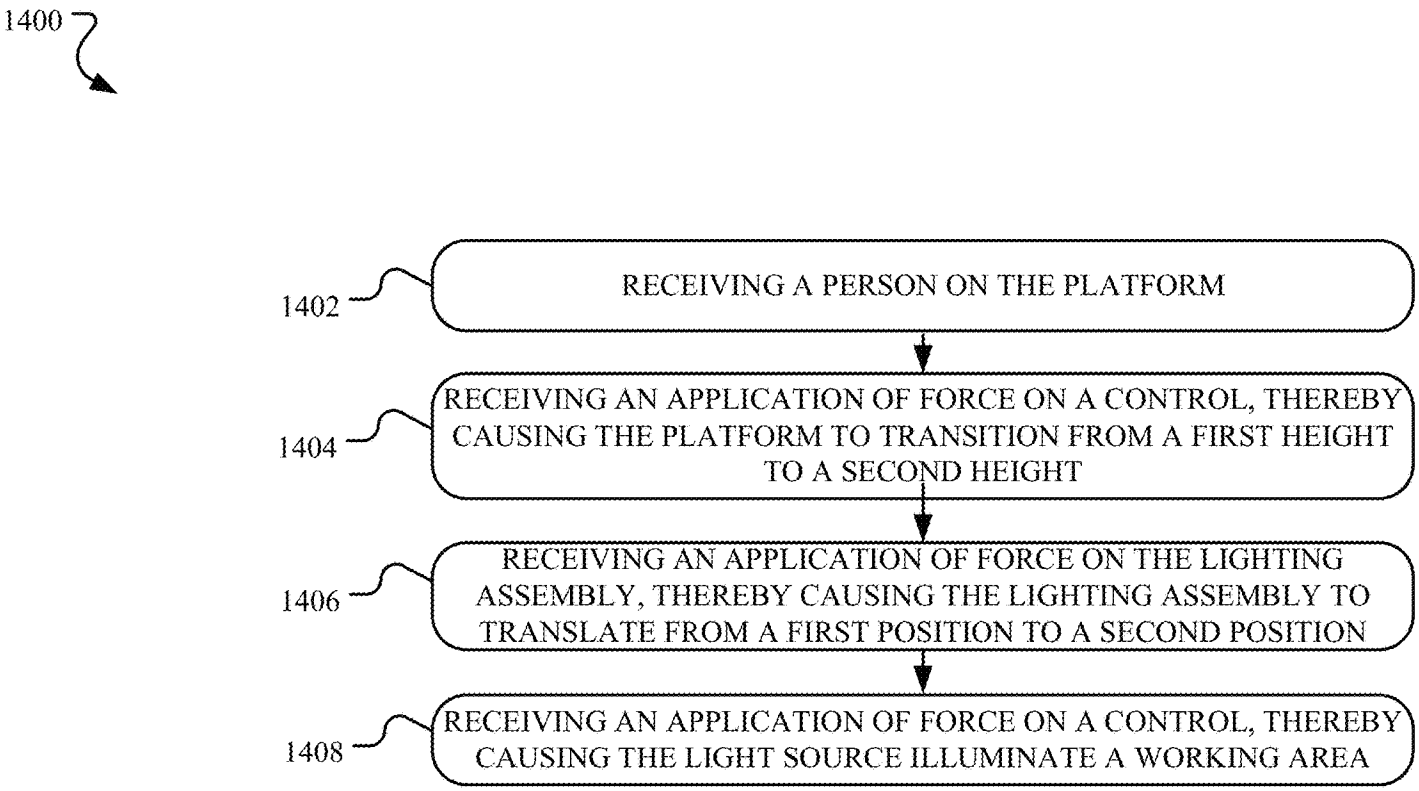
FIG. 14 shows a flowchart of a method for adjusting the adjustable tattoo table.

Referring to FIGS. 14-15, a method 1400 of adjusting an adjustable tattoo table 100 (which is supporting a person 10 receiving a tattoo as illustrated for example in FIG. 1) is discussed, according to one implementation. A flowchart of the method 1400 for adjusting a tattoo table 100 is shown in FIG. 14. The method 1400 is discussed in conjunction with FIGS. 15A-15D, among others. FIGS. 15A-15D illustrate perspective views of the adjustable tattoo table 100 having the platform 102 in a lowered position, intermediate position, elevated position, and elevated position with the lighting assembly 108 having been translated, respectively.

The method 1400 is provided by way of example, as there are a variety of ways to carry out the method 1400. The method 1400 described below can be carried out using the configurations illustrated in FIGS. 1-13C and 15A-15D, for example, and various elements of these figures are referenced in explaining example method 1400. Each block shown in FIG. 14 can represent one or more processes, methods or subroutines, carried out in the example method 1400. Furthermore, the illustrated order of blocks is illustrative only and the order of the blocks can change according to the present disclosure. Additional blocks may be added or fewer blocks may be utilized, without departing from this disclosure.

Beginning with method 1400, at block 1402, a person 10 is received on the platform 102 (as illustrated for example in FIG. 1). The platform 102 supports the person 10 while the person 10 receives a tattoo on his or her body 12. When the platform 102 receives the person 10, the platform 102 can be at a first height. The longitudinal axis LAP of the platform 102 is substantially horizontal. Moreover, a plane defined by platform 102 (e.g., a plane defined by the top surface 125 of the padded body 124) is substantially horizontal.

Figure 15A:
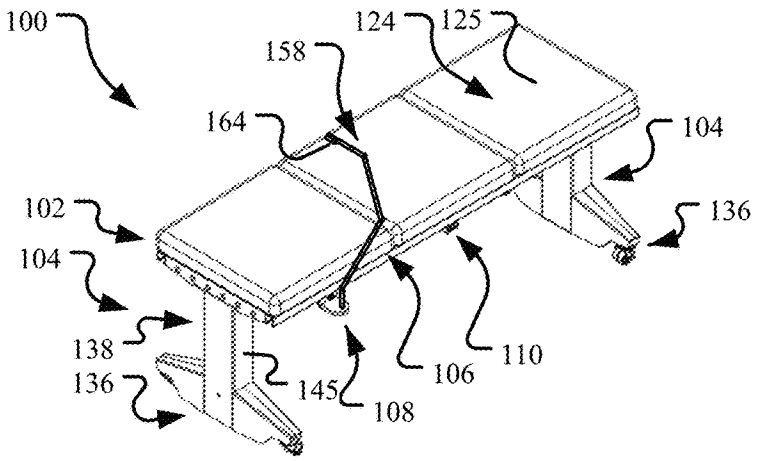
FIGS. 15A-15D illustrates perspective views of the adjustable tattoo table having the platform in a lowered position, intermediate position, elevated position, and elevated position with the lighting assembly translated, respectively.
Figure 15B:
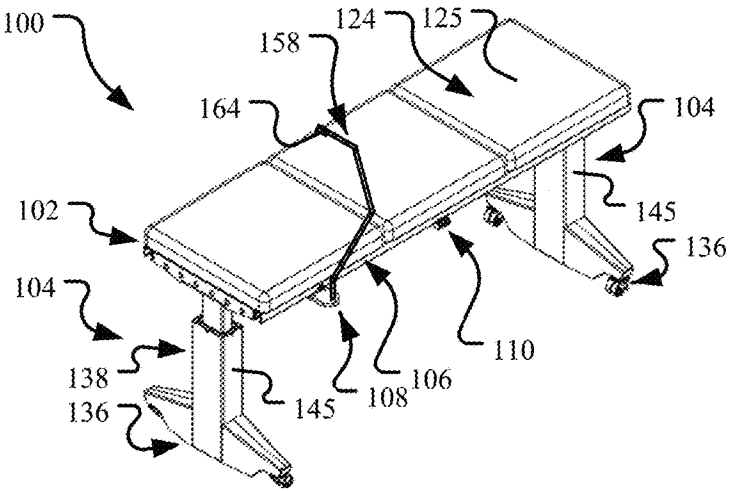
Figure 15C:
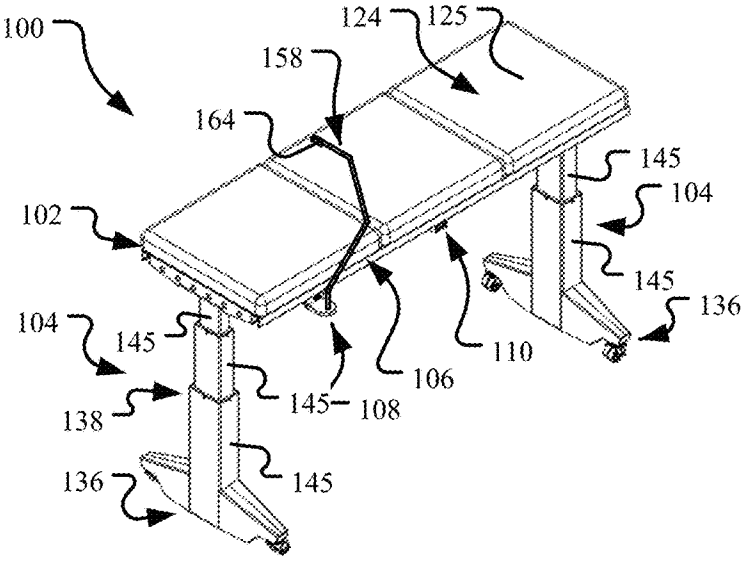

Continuing with method 1400, at block 1404, a control 174 (e.g., of the controller 110) receives an application of force, which causes the platform 102 to transition from a first height to a second height that is different than the first height. For example, FIG. 15A illustrates the platform 102 at a first height, FIG. 15B illustrates the platform 102 at a second height, and FIG. 15C illustrates the platform 102 at a third height.

In some examples, the platform 102 transitions from a first height to a second height that is greater than the first height. For example, the platform 102 can transition to a higher height, such as illustrated in the transition between FIG. 15A and FIG. 15B. Similarly, the platform 102 can transition to a higher height, such as illustrated in the transition between FIG. 15B and FIG. 15C.

In some examples, the platform 102 transitions from a first height to a second height that is less than the first height. For example, the platform 102 can transition to a lower height, such as illustrated in the transition between FIG. 15C and FIG. 15B. Similarly, the platform 102 can transition to a lower height, such as illustrated in the transition between FIG. 15B and FIG. 15A.

To transition the height of the platform 102, the first adjustable support 104 supporting the left end 112 (e.g., first end) and the second adjustable support 104 supporting the right end 114 (e.g., second end) can be simultaneously actuated (e.g., raised, lowered). Because the first and second adjustable supports 104 are simultaneously actuated, the longitudinal axis LAP of the platform 102 remains substantially horizontal when the height of the platform 102 is transitioning. Similarly, the plane defined by platform 102 (e.g., a plane defined by the top surface 125 of the padded body 124) remains substantially horizontal when the height of the platform 102 is transitioning.

The first adjustable support 104 and the second adjustable support 104 actuate (e.g., raise, lower) along respective longitudinal axes LAS. Thus, a length L between the first adjustable support 104 and the second adjustable support 104 is constant whether the platform 102 is at a first height, transitioning between a first height and a second height, or at a second height. Thus, the first adjustable support 104, the second adjustable support 104, and a bottom of the platform 102 define an open volume that can receive a portion of the body of the tattoo artist (e.g., foot, leg) and/or equipment (e.g., chair) while the tattoo artist is tattooing the body 12 of the person 10.

Continuing with method 1400, at block 1406, the lighting assembly 108 receives an application of force, which causes the lighting assembly 108 to translate from a first position to a second position on the support rail 106. The support rail 106 slidably supports the lighting assembly 108, such that the lighting assembly 108 is operable to slide along a longitudinal axis LAR of the support rail 106. In some examples, the lighting assembly 108 translates from a first position to a second position that is to the right of the first position. For example, the lighting assembly 108 can be translated to a further right position, such as illustrated in the translation of the light assembly 108 between FIG. 15C and FIG. 15D. In other examples, the lighting assembly 108 translates from a first position to a second position that is to the left of the first position. For example, the lighting assembly 108 can be translated to a further left position, such as illustrated in the translation of the light assembly 108 between FIG. 15D and FIG. 15C.

The support rail 106 is coupled to (or part of) the frame 120 of the platform 102, as illustrated for example in FIG. 2 and FIG. 5, such that the height of the lighting assembly corresponds to the height of the platform 102. In other words, when the height of the platform 102 transitions (e.g., raised, lowered), the height of the light assembly 108 correspondingly transitions (e.g., raises, lowers). The longitudinal axis LAR of the support rail 106 is substantially parallel to the longitudinal axis LAP of the platform 102.

Figure 15D:
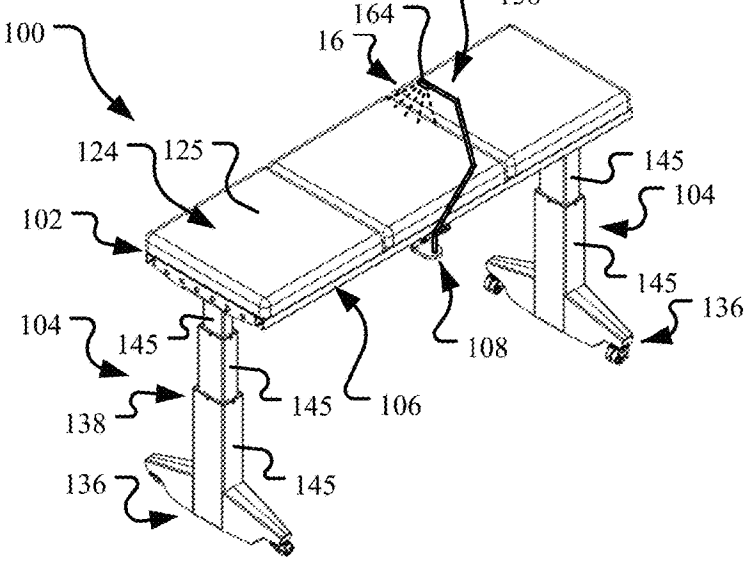

Continuing with method 1400, at block 1408, a control 174 (e.g., of the controller 110) receives an application of force, which causes the light source 164 to provide light 16 and illuminate a working area (or portion thereof). For example, FIG. 15D illustrates the light source 164 turned on (e.g., illuminated). In some examples, the brightness (e.g., brighter, dimmer) of the light source 164 can be adjusted. In some examples, one or more articulating arms 162 of the lighting assembly 108 can be articulated to position the light source 164.

Based upon design preferences, it is understood that the specific order or hierarchy of steps in the methods described herein can be rearranged while remaining within the disclosed subject matter. Any accompanying method claims present elements of the various steps in a sample order and are not necessarily meant to be limited to the specific order or hierarchy presented.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

The above specification, examples, and data provide a complete description of the structure and use of example implementations of the presently disclosed technology. Various modifications and additions can be made to the exemplary implementations discussed without departing from the spirit and scope of the presently disclosed technology. For example, while the implementations described above refer to particular features, the scope of this disclosure also includes implementations having different combinations of features and implementations that do not include all of the described features. Accordingly, the scope of the presently disclosed technology is intended to embrace all such alternatives, modifications, and variations together with all equivalents thereof.

What is claimed is:

1. An adjustable tattoo table for supporting a person being tattooed, the adjustable tattoo table comprising:

a platform extending from a first end to a second end and having a plane that is substantially horizontal, the platform being located a height above ground;

a padded body of the platform, the padded body defining a top surface that is operable to support the person being tattooed;

a first support coupled to the platform at the first end, the first support configured to extend or retract along a longitudinal axis of the first support, wherein the longitudinal axis of the first support is substantially perpendicular to the longitudinal axis of the platform;

a second support coupled to the platform at the second end, the second support configured to extend or retract along a longitudinal axis of the second support, wherein the longitudinal axis of the second support is substantially perpendicular to the longitudinal axis of the platform;

wherein the first support and the second support define an open volume therebetween;

wherein the height of the platform raises when the first support and the second support are each extended, wherein the height of the platform lowers when the first support and the second support are each retracted;

a support rail coupled to the platform and defining a length, the support rail including a channel, the channel including an opening along an underside of the support rail, such that the opening is directed toward the ground;

a slidable mount slidably engaging the support rail, the slidable mount comprising:

a vertical portion extending vertically downward in a direction perpendicular to the plane of the platform from a first end of the vertical portion within the channel to a second end of the vertical portion exterior to the channel, the vertical portion including a first pair of wheels that are received within the channel and a second pair of wheels which abut the support rail along an underside surface of the support rail; and a horizontal portion extending horizontally from the second end of the vertical portion, the horizontal portion supporting a lighting assembly at a position, wherein the position of the lighting assembly is slidably adjustable along the length of the support rail; and one or more controllers, wherein the one or more controllers are operable to cause the first support and the second support to extend or retract to cause the height of the platform to transition.

2. The adjustable tattoo table of claim 1, wherein the one or more controllers are configured to cause the first support and the second support to each extend or retract simultaneously.

3. The adjustable tattoo table of claim 1, wherein the platform defines a normal line that is substantially parallel to both the longitudinal axis of the first support and the longitudinal axis of the second support, wherein the normal line remains substantially parallel to both the longitudinal axis of the first support and the longitudinal axis of the second support when the height of the platform is transitioning.

4. The adjustable tattoo table of claim 1, wherein the longitudinal axis of the platform remains substantially horizontal when the height of the platform is transitioning.

5. The adjustable tattoo table of claim 1, wherein the platform further comprises a frame supporting a substrate having the top surface, the padded body being releasably engaged to the frame or the top surface of the substrate via magnets, a light source located below the top surface of the substrate and the substrate constructed of a non-opaque material, the light source and the substrate forming a light box when the light source is illuminated and the padded body is removed from the substrate.

6. The adjustable tattoo table of claim 1, wherein both the support rail and at least one of the one or more controllers are located on a front side of the platform.

7. The adjustable tattoo table of claim 1, wherein the slidable mount is a first slidable mount, the adjustable tattoo table further comprising:

a second slidable mount slidably engaging the support rail, the second slidable mount supporting the one or more controllers.

8. The adjustable tattoo table of claim 7, wherein the channel of the support rail is a first channel, the second slidable mount comprising:

a top portion;

a button portion spaced apart from the top portion in the direction perpendicular to the plane of the platform; and a second channel defined between the top portion and the bottom portion, wherein the top portion of the second slidable mount is received within the first channel, the bottom portion of the second slidable mount abuts the support rail on an underside of the support rail, and at least a portion of the support rail is received within the second channel.

9. The adjustable tattoo table of claim 1, wherein the one or more controllers are operable to control an illumination of the lighting assembly.

10. An adjustable tattoo table for supporting a person being tattooed, the adjustable tattoo table comprising:

a platform extending from a first end to a second end and having a longitudinal axis that is substantially horizontal, the platform being located a height above ground;

a padded body of the platform, the padded body defining a top surface that is operable to support the person being tattooed, the top surface defining a plane that is substantially horizontal;

a first support coupled to the platform at the first end and a second support coupled to the platform at the second end, wherein the first support and the second support are each operable to extend such that the height of the platform raises, wherein the first support and the second support are each operable to retract such that the height of the platform lowers, wherein the longitudinal axis of the platform remains substantially horizontal when the height of the platform is raised or lowered;

a support rail coupled to the platform and defining a length, the support rail including a channel, the channel including an opening along an underside of the support rail, such that the opening is directed towards the ground;

a slidable mount slidably engaging the support rail, the slidable mount comprising:

a vertical portion extending vertically downward in a direction perpendicular to the plane of the platform from a first end of the vertical portion within the channel to a second end of the vertical portion exterior to the channel, the vertical portion including a first pair of wheels that are received with the channel and a second pair of wheels which abut the support rail along an underside surface of the support rail; and a horizontal portion extending horizontally from the second end of the vertical portion, the horizontal portion supporting a lighting assembly at a position, wherein the position of the lighting assembly is slidably adjustable along the length of the support rail; and one or more controllers, wherein the one or more controllers are operable to cause the first support and the second support to extend or retract simultaneously such that the top surface remains substantially horizontal.

11. The adjustable tattoo table of claim 10, wherein the first support, the second support, and a bottom of the platform define an open volume therebetween, wherein the open volume is configured to receive at least a portion of one or more legs of a tattoo artist.

12. The adjustable tattoo table of claim 10, further comprising a safety in communication with the one or more controllers, the safety operable to inhibit the first support and the second support from extending or retracting.

13. The adjustable tattoo table of claim 10, wherein the support rail defines a longitudinal axis, wherein the longitudinal axis of the support rail is substantially parallel to the longitudinal axis of the platform.

14. The adjustable tattoo table of claim 10, wherein the platform further comprises a frame supporting the padded body, wherein the support rail is part of the frame of the platform.

15. The adjustable tattoo table of claim 10, wherein the first support defines a first longitudinal axis, the first support configured to extend or retract along the first longitudinal axis, wherein the second support defines a second longitudinal axis, the second support configured to extend or retract along the second longitudinal axis, wherein the first longitudinal axis is substantially parallel to the second longitudinal axis.

16. The adjustable tattoo table of claim 15, wherein the first support comprises a first linear actuator and the second support comprises a second linear actuator.

17. The adjustable tattoo table of claim 10, wherein the padded body is releasably secured to the platform, wherein removing the padded body from the platform exposes a substrate comprising a non-opaque material that defines the top surface, wherein a light source provides a backlight for the top surface of the substrate.

18. The adjustable tattoo table of claim 10, wherein both the support rail and at least one of the one or more controllers are located on a front side of the platform.

19. A method of supporting a person on an adjustable tattoo table when the person is receiving a tattoo, the method comprising:

receiving the person on a platform at a first height, the platform having a first end and a second end and defining a longitudinal axis that is substantially horizontal, the platform defining a top surface defining a plane that is substantially horizonal to a ground, the platform supported by a first support at the first end and a second support at the second end, the first support and the second support defining an open area therebetween;

receiving a first application of force on a control of a controller, wherein the first application of force causes the platform to transition from the first height to a second height, the second height being different than the first height, the plane remaining substantially horizontal when the platform transitions from the first height to the second height;

receiving a second application of force on a lighting assembly, wherein the second application of force causes a slidable mount supporting the lighting assembly to translate from a first position on a rail to a second position on the rail, the second position being different than the first position, the rail coupled to the platform and parallel to the longitudinal axis of the platform, the rail including a channel, the channel including an opening along an underside of the rail, the opening directed toward the ground, the slidable mount including a vertical portion extending vertically downward in a direction perpendicular to the plane of the platform from a first end of the vertical portion within a channel of the rail to a second end of the vertical portion exterior to the channel, the vertical portion including a first pair of wheels that are received within the channel and a second pair of wheels which abut the rail along an underside surface of the rail, the slidable mount further including a horizontal portion extending horizontally from the second end of the vertical portion, the horizontal portion and supporting the lighting assembly, the lighting assembly including a light source; and receiving a third application of force on a control of a controller, wherein the third application of force causes the light source to illuminate at least a portion of a working area.

20. The method of claim 19, wherein the first support and the second support each extend along a longitudinal axis when the platform transitions from the first height to the second height, wherein the longitudinal axis of the first support and the second support are substantially perpendicular to the longitudinal axis of the platform.

* * * * *